US007665290B2

(12) United States Patent
Ueda et al.

(10) Patent No.: US 7,665,290 B2
(45) Date of Patent: Feb. 23, 2010

(54) TWISTER, METHOD FOR PRODUCING TWISTED WIRE, PLY, AND PNEUMATIC TIRE

(75) Inventors: Shogo Ueda, Tokyo (JP); Yoshiki Mizuta, Tokyo (JP); Kojiro Torisu, Tokyo (JP); Kiyotaka Yoshii, Tokyo (JP)

(73) Assignee: Bridgestone Corporation, Tokyo (JP)

( * ) Notice: Subject to any disclaimer, the term of this patent is extended or adjusted under 35 U.S.C. 154(b) by 28 days.

(21) Appl. No.: 10/536,446

(22) PCT Filed: Nov. 25, 2003

(86) PCT No.: PCT/JP03/15025

§ 371 (c)(1),
(2), (4) Date: Sep. 8, 2005

(87) PCT Pub. No.: WO2004/048679

PCT Pub. Date: Jun. 10, 2004

(65) Prior Publication Data

US 2006/0151081 A1 Jul. 13, 2006

(30) Foreign Application Priority Data

Nov. 25, 2002 (JP) ..... 2002-341037

(51) Int. Cl.
*D07B 1/00* (2006.01)

(52) U.S. Cl. ..... 57/314

(58) Field of Classification Search ..... 57/22, 57/23, 68, 311, 314

See application file for complete search history.

(56) References Cited

U.S. PATENT DOCUMENTS 1,345,375 A * 7/1920 Lemay ..... 57/22
3,005,304 A * 10/1961 Holm ..... 57/12
3,388,541 A 6/1968 Biagini
3,646,743 A 3/1972 Boyd
3,675,407 A * 7/1972 LaRue ..... 57/22
3,729,913 A * 5/1973 Wray ..... 57/22
3,750,720 A 8/1973 Steigerwald
4,341,065 A * 7/1982 Baumgartner et al. ..... 57/22
4,530,205 A * 7/1985 Seiler et al. ..... 57/9
4,549,394 A * 10/1985 Preussner ..... 57/58.57

(Continued)

FOREIGN PATENT DOCUMENTS

DE 93-15-731 U1 12/1994

(Continued)

*Primary Examiner*—Shaun R Hurley
(74) *Attorney, Agent, or Firm*—Sughrue Mion, PLLC

(57) ABSTRACT

A compact twister and a method for producing a twisted wire that can efficiently produce a short twisted wire that satisfies performance requirements, as well as a ply and a pneumatic tire twisted using the twister or the method for producing a twisted wire, are provided. The twister includes a rotating body for twisting plural filament wires that are fed thereto to form a cord and for applying a feeding force to the cord. The rotating body includes a feeding mechanism within a housing, and the cord is discharged from the rotating body by the feeding mechanism. The twister carries out twisting operation with one of a cord side of a twisting point or a filament wire side of the twisting point being free. Thus, a compact twister, that can form a cord with excellent rotating property and straightness, is accomplished.

13 Claims, 28 Drawing Sheets

U.S. PATENT DOCUMENTS

| | | | | |
|---|---|---|---|---|
| 6,327,843 | B1 | 12/2001 | Cipparrone et al. | |
| 6,378,283 | B1 * | 4/2002 | Barton | 57/58.52 |
| 6,412,263 | B1 | 7/2002 | Lee et al. | |
| 6,446,423 | B1 * | 9/2002 | Noferi | 57/58.52 |
| 6,631,609 | B2 * | 10/2003 | Scheunemann | 57/241 |

FOREIGN PATENT DOCUMENTS

| | | | |
|---|---|---|---|
| EP | 1059380 | A2 | 12/2000 |
| GB | 1016046 | A | 1/1966 |
| JP | 56-112591 | A | 9/1981 |
| JP | 03-019809 | A | 1/1991 |
| JP | 4-352888 | A | 7/1992 |
| JP | 8-027687 | A | 1/1996 |
| JP | 08-203357 | A | 8/1996 |
| JP | 9-078476 | A | 3/1997 |
| JP | 3411887 | B2 | 3/2003 |

* cited by examiner

TWISTER, METHOD FOR PRODUCING TWISTED WIRE, PLY, AND PNEUMATIC TIRE

BACKGROUND OF THE INVENTION

1. Field of the Invention

The present invention relates to a twister for producing a twisted wire by twisting plural wire materials, and a method for producing a twisted wire, a ply, and a pneumatic tire. More particularly, the present invention relates to a twister that is suitable for producing a tire reinforcing cord for use in a tire, a method for producing a twisted wire, a ply, and a pneumatic tire.

2. Description of the Background Art

In conventional mass production of cord products, such as steel cords, basically, twisters are used to continuously twist wires and the resulting product (cord) is taken up on a reel. When several solid wires are twisted together to produce a cord, it is necessary to make twisting rotation at both sides of a twisting point of the wires along a progressing direction of the wires. Therefore, it is necessary to rotate one of the material (i.e., the solid wires) side and the product (i.e., the cord) side of the wires in the same direction of the twisting rotation, or alternatively, it is necessary to make one of the solid wires and the cord supported within a rotating body and advance along the rotating body rotating around the wires or the cord, so that the one of the solid wires and the cord is twisted around the other of the solid wires and the cord (see, for example, Japanese Patent Application Laid-Open (JP-A) Nos. 6-200491 and 9-291488).

Further, in tire production, a sheet-like tire intermediate material is made, in which steel cords are embedded in a barred lattice pattern in a rubber sheet. It is thus desired that the steel cord used as a tire reinforcing material is as long and continuous as possible, and is generally produced to have a length of several thousand meters to tens-of-thousands of meters.

A method is known, where a product (twisted wire) is produced by repeatedly inverting a twisting direction at certain intervals with opposite ends being fixed, and therefore unrotated. However, in this method, although each area that is shorter than the interval of the inversion remains twisted, there are inevitably sections where the wires are not twisted between the inversion intervals. In addition, since the twist of the product is cancelled as a whole by the repeated inversion, this method does not produce a good twisted wire.

In order to produce a cord, it is necessary to twist wires as many times as possible within a short time.

However, since only a single or double twisting can be made by a single rotation of a device (a single rotation of a rotating body), there arises a problem that a number of devices (twisters) are necessary. The equipment investment for the devices of this type actually constitutes a large portion of cord production costs.

It is desirable that a twister can rotate at a high-speed. There is a natural limit in the rotation speed of the twister, due to the durable load of a centrifugal force resulting from high-speed rotation and rotational vibration. If a twister is made compact and a rotation frequency thereof is increased to reduce the equipment cost, a winding size of a bobbin is decreased and the bobbin must be replaced more frequently, resulting in lower efficiency. In addition, there is also a limit in size reduction in view of ensuring continuity during the tire production process.

In contrast, if a winding size of a bobbin is increased to reduce required operation steps, a twister becomes huge and a centrifugal force is increased, and therefore a rotation speed cannot be increased, resulting in increase in the equipment cost. Due to this problem, a size and a rotation speed of a twister are set at compromising values in consideration of a balance therebetween, and this makes it difficult to reduce production costs further from the current level.

In addition, since it is normal practice to continuously produce a product having a length of several thousands to several ten-thousands meters, if a problem such as a wire breaking occurs during production, it is necessary to remove a defective product, whose length does not reach a predetermined length, through specific operations such as scrapping or welding. That is, a significant number of extra processes are required to recover the normal state of production.

In tire production, a large quantity of steel cords are processed at the same time with a large calendaring machine or stelastic. Therefore, a process lot is large and this leads to potential problems of increase in stock and increase in a lead time from production to shipment. Further, since it is troublesome to change properties of steel cords for each tire product and/or for each portion of a tire (this would result in low production efficiency), production of diverse products has been inhibited.

In addition, since a continuous steel cord is generally produced and supplied in conventional steel cord production processes, although quality characteristics of a cord can be altered in a longitudinal direction thereof, it is difficult to correctly locate each site of a cord at its specified position on a tire all the time. Therefore, in order to alter quality characteristics of a steel cord in accordance with the respective sites of a tire, it is necessary to form a tire in a state where a corresponding number of intermediate cord-rubber composite products have been prepared.

Moreover, in cord production using conventional twisters, it is difficult to reduce and stabilize levels of rotating property and straightness of cords, which significantly influence operational efficiency of a cutting process and a forming process at tire factories. Although efforts have been made on quality improvement and stabilization of the rotating property and the straightness of cords, these are still problems that have not yet been solved.

SUMMARY OF THE INVENTION

In view of the foregoing facts, the present invention is directed to provide a compact twister and a method for producing a twisted wire, which can efficiently produce short twisted wires that satisfy performance requirements. The invention is also directed to provide a ply including twisted wires that are twisted with the twister or twisted according to the method for producing a twisted wire, and a pneumatic tire including the plies.

In one aspect a twister includes a rotating body for twisting a plurality of wire materials fed thereto to form a twisted wire; and a discharging device for discharging the twisted wire from the rotating body, wherein one of a twisted wire side downstream of a twisting point and a wire material side upstream of the twisting point, of the wire, is free.

The term "free" used herein refers to a state where one of the end portions of the wire, at opposite sides with respect to the twisting point, can be rotated in accordance with a twisting rotation.

Even when a relative rotation is inevitably generated between the twisted wire side downstream of the twisting point and the wire material side upstream of the twisting point, since one of the end portions at the twisted wire side and at the wire material side is free, the twisted wire can be discharged from the twister with the twisted wire rotating, or the wire materials can be fed to the twister with the wire materials rotating, during the twisting operation. It is preferable that the wire materials or the twisted wire is shorter at the "free" side than the other side, in view of a structure of the twister and quality of the product (twisted wire).

In a case where the wire materials or the twisted wire is sufficiently short, at the free side, a shape of each wire material is maintained by the rigidity of the wire itself. Therefore, the rotating wire materials need no guide member in contact therewith, or end portions of the wire materials can be positioned by a simple guide member that slightly contacts the rotating wire materials to guide and align them, thus enabling discharging of the twisted wire or feeding of the wire materials where the wire materials keep rotating.

In a case where the wire materials is relatively long at the free side thereof or where the wire materials are to be positioned at the free side thereof with high accuracy, it is possible to make the wire materials or the twisted wire relatively long at the free side by using a guide member or a chuck member that can rotate freely or synchronously so as not to hinder the rotation of the wire materials or the twisted wire. However, since the longer wire materials or twisted wire requires larger facilities, it is preferable that the length does not exceed about 10 m in an economic point of view.

A material type of the wire materials is not particularly limited, and the wire material may be a filament wire or a strand. A type of twisting is not particularly limited, and may include single twisting, multiple twisting, layered twisting, and the like. In a case where the wire material is a filament wire, a strand is produced (for example, if a material of the filament wire is steel, a steel strand is produced with the twister).

The discharging device may include various mechanisms such as one including a chuck to pinch and pull the twisted wire or one including a roller to nip and push the twisted wire out from the rotating body. It is necessary that the discharging device does not hinder the rotation of the wire materials or the twisted wire at the free side.

The wire materials can be fed to the twister with a conventional technique for unwinding a wire material. For example, filament wires unwound with a constant tension may be passed through a preforming device or a jig to ensure necessary preforming to obtain final cord quality, and then, twisted by the twister and discharged from the rotating body. The discharged twisted wire is pushed out by its own rigidity and comes out with rotating in the same direction as the rotating body.

For example, in a case where a tire reinforcing cord is produced, the twisted wire is subsequently cut to a predetermined length to provide final tire reinforcing cord products. In this case, it is advantageous in view of cutting equipment costs and enhancing production efficiency that an exit portion of the twister is directly connected to a tire member producing apparatus to carry out cutting and rubber coating operations in a combined manner. Further, it is advantageous that the twister is coupled to or combined into the facilities for processing and forming tire members.

Further, since the cord is formed into a composite with rubber that is a tire reinforcing material in a state where the cord is freely rotatable, the cord makes no rotation or exhibits no tendency to rotate in the composite.

In addition, with respect to the straightness of the cord, since each wire is twisted, a stress distribution in a filament circumferential direction is made even, and therefore a straight cord can be obtained. This principle similarly applies to conventional buncher-type twisters. However, in conventional buncher-type twisters, after a cord has been twisted, the cord passes through a guide, a pulley, a roller, and the like, and this process adversely affects the straightness of the cord which has been once straightened by twisting. Further, in conventional production methods, since a produced cord is taken up on a reel, the cord wound on the reel acquires a curling tendency over time and this further deteriorates straightness. On the other hand, in the present invention, a twisted cord is linearly discharged and is not taken up on a reel. Therefore, straight cords can be provided in a stable and continuous manner.

As described above, twister can be realized, wherein plural solid wires are twisted by a rotating body to form a twisted wire, and the twisted wire discharged from the rotating body is not taken on a reel as in the conventional twisters. In this manner, a compact twister that can form a twisted wire with excellent rotating property and straightness can be realized, and a required space as well as a price of this twister can be made one tenth of conventional twisters generally used in steel cord production.

When a twisted wire is produced using the twister the type of a wire material can be arbitrary selected. For example, a single or plural filament wires as a core and plural filament wires to form a sheath may be fed as wire materials, to produce a layered twisted cord with a compact structure, in which the core and the sheath are twisted in the same direction with the same pitch. Alternatively, plural filament wires as a core, which have been twisted in advance, may be unwound to be fed to the twister, to produce a layered twisted cord, in which pitches are different between the core and the sheath. Yet alternatively, a strand formed of two to seven filament wires that have been twisted in advance may be used as a wire material to be unwound and fed, to produce a multiple-twist cord. Further, a twisted wire may be made of two or more materials by selecting, as wire materials to be fed, plural filament wires of different materials. Moreover, a composite of a cord and rubber may be produced by twisting filament wires of steel, or the like, with a rubber-coated wire material or rubber processed to have a string-like shape.

The discharging device may be provided at the rotating body. When the discharging device and the rotating body are integrated in one structure, a size of the twister can be reduced.

The discharging device may include a moving mechanism for holding the rotating body to be movable in a direction in which the twisted wire is discharged, and a rotating chuck provided at the rotating body for removably chucking the twisted wire.

The moving mechanism is a mechanism that holds the rotating body with a bearing or the like so that the rotating body can rotate freely. In order to discharge the twisted wire from the rotating chuck by a predetermined length, the twisted wire is chucked by the rotating chuck, and the rotating chuck in rotation is moved in a discharging direction by the moving mechanism. Subsequently, the twisted wire is released from the rotating chuck and the rotating chuck is returned to its original position by the moving mechanism. As a result, the twisted wire is discharged from the rotating chuck by a predetermined length.

A function of discharging the twisted wire and a function of applying rotation to the rotating body may be provided integrally or separately.

In a case where these functions are provided separately, a portion of the discharging device gripping the wire is made to rotate freely so that the discharging device does not hinder twisting rotation. By providing these functions separately, it becomes easier to optimally design each of twisting function of the rotating body and discharging function of the discharging device, and to provide a twisting device where plural twisters are combined.

In a case where the above functions are provided integrally, it is necessary to provide a device for rotating the discharging device and the rotating body integrally or synchronously. However, this structure can make the best use of the advantage of the invention that the entire twister is compact and simple. In this case, the cord may be driven frictionally by plural rolls nipping the cord. However, since a large contact pressure is required to obtain a necessary driving force by simply nipping with the rolls, it is better to effect nipping with a multi-step mechanism or a caterpillar-like mechanism to prevent deterioration of product quality and durability of the device. As an approach for reducing the large contact pressure, the cord may be wound on a capstan to ensure a certain degree of frictional force and nipped by a roller in this state to drive the cord with a minimum contact pressure.

In addition, the twister may be provided with a function of cutting a twisted product (twisted wire). In this structure, the twisted product (twisted wire) can be successively cut to a necessary length easily.

A ratio of a rotational speed of the rotating body to a discharging speed of the discharging device may be variable, and rotation and discharge may be effected with different timings. This facilitates to make the twisting pitch variable. For example, in a case of a twister including the rotating chuck and the moving mechanism described above, the moving mechanism may pull out the wire material by a predetermined length and stop its move, and then, the rotating chuck may be rotated to apply a necessary number of twists to the wire material. In this case, twisting is effected across the entire pulled-out portion of the twisted wire. Therefore, twisting is not limited to a point, but is effected over a certain length. Note that the term "a twisting point" herein refers to a place where twisting is carried out, and therefore, a difference in size of the place, i.e., long or short, does not contradict the spirit of the invention.

A twisting pitch is determined by a ratio of a rotational speed of the rotating body to a feeding speed of the wires to be twisted (a ratio of a speed of twisting rotation to a feeding speed of the wires to be twisted). Therefore, in order to have the twisting pitch constant, it is better to mechanically set the speed ratio. A twisting pitch can be freely changed at any time by making this ratio variable or enabling the speeds to be set freely by providing separate driving systems.

The twister of the invention is more suitable for producing very short twisted wire products having a length of several tens centimeters to several meters, which are used in an actual tire, rather than producing long twisted wire products having a length of several thousands to several ten-thousands meters. In this case, since it is not necessary to draw out a long twisted wire or to take up the twisted wire on a reel, the twisted wire can be linearly discharged from the rotating body with an end of the twisted wire rotating, to produce the twisted wire. Since a large rotating section such as those in conventional twisters is not necessary, and there is no need for a device to take up a twisted wire, the twister of the invention can be made remarkably smaller and simpler than conventional twisters. That is, device costs can be reduced and production of twisted wires can be carried out in a small space.

Further the advantages of lower costs and compactness of the twister of the invention can be easily obtained by connecting the plural twisters in parallel to a single power unit and driving these twisters.

When a cord is produced, the cord, which is a product, and filament wires, which are components of the cord, can be placed outside of the rotating body. Since bobbins, on which filament wires are wound, are not placed inside with respect to the rotating cord, there is no need of stopping rotation of the rotating body when the bobbins (reels) are replaced to supply filament wires. Further, by increasing amounts of filament wires wound on the bobbins or continuously unwinding filament wires, a cord can be continuously produced without stopping rotation of the rotating body.

By combining a tire production apparatus and the twister good effects such as quick response to a small lot, reduction of space, elimination of cord stock, reduction of transportation work, elimination of wrapping materials for bobbins, or the like, can be achieved.

Further, different from a conventional case where a huge calendaring machine is used to produce a tire intermediate member, small-lot cord production is possible, and cords can be produced when they are needed, right before a tire production facilities.

A method for producing a short twisted wire by twisting a plurality of wire materials, wherein twisting is carried out with one of a twisted wire side downstream of a twisting point and a wire material side upstream of the twisting point, of the wire, being free. With this method, a twisted wire with excellent rotating property and straightness can be formed.

In this case, a twister including a rotating body for twisting the plurality of wire materials to form the twisted wire and a discharging device for discharging the twisted wire from the rotating body may be used in the method, and a ratio of a rotational speed of the rotating body to a discharging speed of the discharging device may be variable to partially change a twisting pitch of the twisted wire.

Thus, a single continuous twisted wire with partially altered twisting pitches can be produced, and the twisting pitch can be set to intended pitches. A twisted wire thus obtained is most suitable for use as a tire reinforcing cord. In other words, by specifying positions at which the cords are embedded in a tire, twisting quality or twisting property of the cord can be changed for each short cord, or for each position of each short cord in accordance with the portion of the tire where each cord is used. That is, twisting quality or twisting characteristics can be adjusted in accordance with the portions of a tire where the cords are to be used. Therefore, short twisted wires satisfying performance requirements can be efficiently produced. In addition, by distributing residual stress, preforming, and the like, tire reinforcing cords with additional qualities can be produced.

It should be noted that the wire material may be a filament wire or a strand.

A ply comprises, as a cord, a twisted wire produced with the twister, or a twisted wire produced according to the method for producing a twisted wire.

This cord has excellent rotating property and straightness, and therefore, a flat belt ply with suppressed torsion and warpage can be obtained according to the invention.

A pneumatic tire comprises the ply recited in claim 8.

Thus, a pneumatic tire with improved tire performances such as uniformity can be accomplished.

DETAILED DESCRIPTION OF THE EMBODIMENTS

Embodiments of the present invention are now described by way of examples.

First Embodiment

Figure 1:
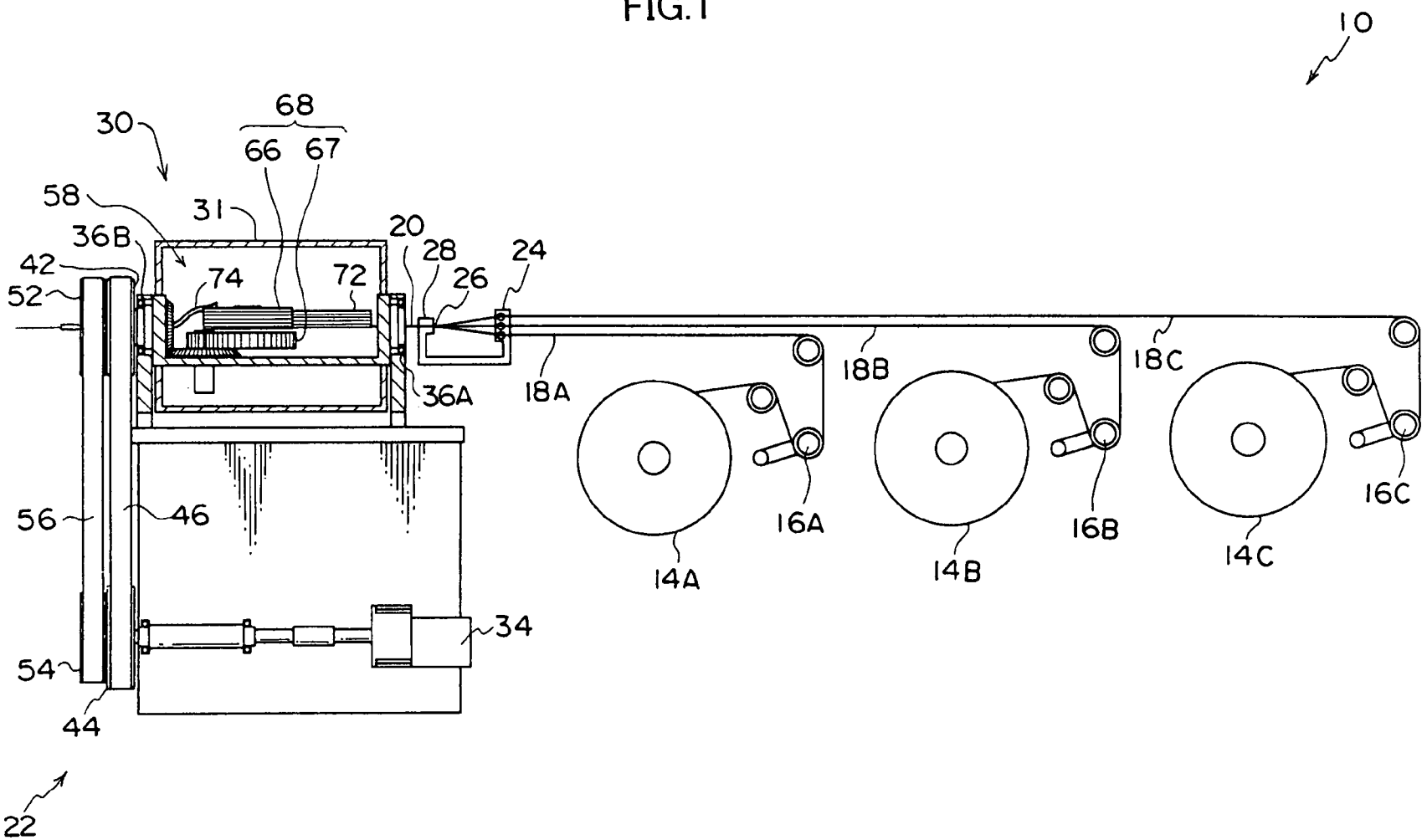
FIG. 1 is a sectional side view illustrating a structure of a twister of a first embodiment.

A first embodiment will be described first. FIG. 1 is a side view illustrating a structure of a twister 22 according to a first embodiment disposed in a cord production line 10. The cord production line 10 includes bobbins 14A to 14C, each of which has a filament wire wound thereon, tension controllers 16A to 16C for respectively controlling tensions of filament wires 18A to 18C unwound from the bobbins 14A to 14C, and a twister 22 for twisting the filament wires 18A to 18C fed via the tension controllers 16 to form a cord 20. The twister 22 is an integrated feeding/rotating device that twists the filament wires 18A to 18C to produce the single cord 20.

The twister 22 includes a preforming section 24 for preforming the filament wires 18A to 18C, a twisting point forming section 28 forming a twisting point 26, a rotating body 30 disposed downstream of the twisting point forming section 28, and a motor 34 for imparting a torque to the rotating body 30 and a force for discharging the cord 20 from the rotating body 30. The rotating body 30 is rotatably supported by bearing sections 36A and 36B disposed at the twister 22.

Figure 2:
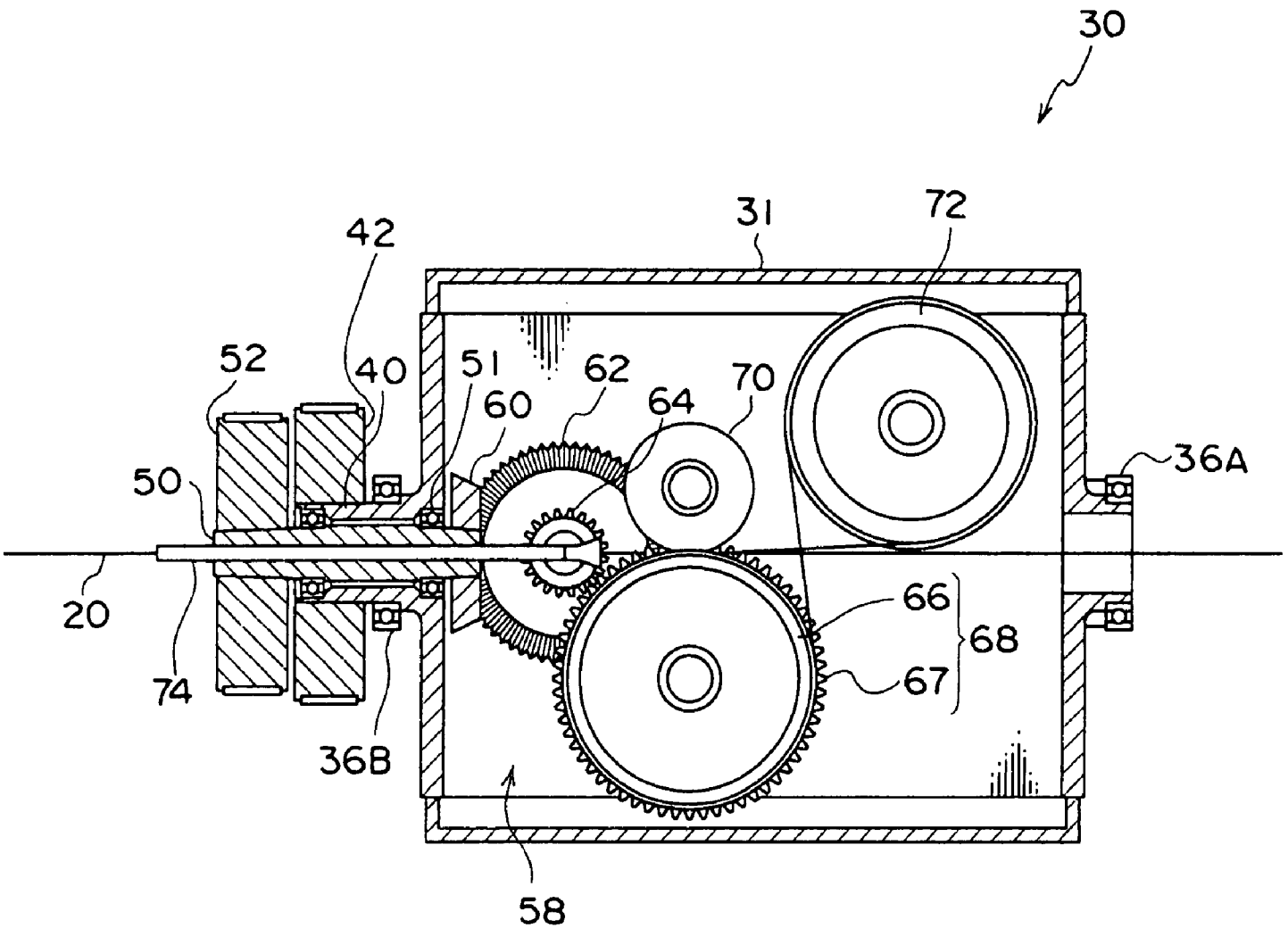
FIG. 2 is a sectional plan view illustrating the twister of the first embodiment.

As shown in FIGS. 1 and 2, at a downstream side of the rotating body 30, a rotation-driving pulley 42 is fixed to a rotation-driving shaft 40 extending like a short cylinder from a housing 31 of the rotating body 30, and an endless belt 46 is supported by the rotation-driving pulley 42 and a first turntable 44 attached to the motor 34.

An elongated tube-like feed-driving shaft member 50 for transmitting a force for feeding the cord 20 is inserted through the rotation-driving shaft 40 so as to share the same rotation axes therewith, and is supported by the rotating body 30 via a bearing section 51. An feed-driving pulley 52 fixed to the feed-driving shaft member 50 is disposed downstream of the rotation-driving pulley 42, and an endless belt 56 is supported by the feed-driving pulley 52 and a second turntable 54 attached to the motor 34.

A feeding mechanism 58 for feeding the cord 20 is provided in the housing 31. The feeding mechanism 58 includes a first gear 60 fixed at a distal end of the feed-driving shaft member 50 coaxially with the feed-driving shaft member 50, and a second gear 62 meshing with the first gear 60. A small gear portion 64 having a smaller diameter is provided at a rotation center of the second gear 62. The feeding mechanism 58 further includes a multi-winding capstan 68 and a pinch roller 70. The multi-winding capstan 68 includes a winding section 66, on which the cord 20 is wound several times and a large gear portion 67 meshing with the small gear portion 64. The pinch roller 70 abuts on the multi-winding capstan 68 to press the cord 20 against the winding section 66. The feeding mechanism 58 further includes a multi-winding dummy pulley 72, on which the cord 20 wound on the multi-winding capstan 68 is further wound several times.

Diameters of the multi-winding capstan 68 and the multi-winding dummy pulley 72 are determined with consideration of diameters and materials of the filament wires 18A to 18C so that there is caused no problem in straightness of the cord 20 when the cord 20 fed from the rotating body 30 is used.

Further, the twister 22 includes a cord discharging pipe guide 74, which is inserted through the feed-driving shaft member 50, for guiding the cord 20 unwound from the multi-winding dummy pulley 72 to a downstream side of the rotating body 30.

A diameter of the first turntable 44 is slightly larger than a diameter of the second turntable 54, to adjust a ratio of a rotational speed of the rotating body 30 (a twisting speed of the twisted wire) to a feeding speed of the cord 20.

As described above, in the present embodiment, the rotation-driving shaft 40 and the feed-driving shaft member 50 are coaxially disposed. This structure of the twister 22 is simpler than a structure where an additional motor for feed-driving is provided in the rotating body 30.

When the twister 22 is used, the motor 34 is rotated at a predetermined rotation speed, thus rotating the feed-driving pulley 52, and then, a torque is sequentially transmitted to the first gear 60, the second gear 62, the multi-winding capstan 68 and the multi-winding dummy pulley 72. As a result, the filament wires 18A to 18C passed through the twisting point forming section 28 is discharged from the rotating body 30 at a predetermined discharging speed.

Further, the rotation-driving dummy pulley 72 rotates, and the rotating body 30 rotates at a predetermined rotational speed. Therefore, the filament wires 18A to 18C are pulled from the twisting point forming section 28 and are twisted to form the cord 20, and the cord 20 is discharged from the rotating body 30.

In this manner, the feed-driving of the cord 20 is effected by the feed-driving shaft member 50 rotating on the rotating body 30 relatively to the rotation-driving shaft 40. In other words, a feeding speed is determined by a difference between a rotation frequency of the feed-driving shaft and a rotation frequency of the rotating body 30.

A ratio of a rotational speed of the rotation-driving shaft 40 to a rotational speed of the feed-driving shaft member 50 is fixed by diameters of the pulleys, around which the belt is supported, and a gear ratio. In order to obtain the cord 20 twisted at an intended twisting pitch, in the present embodiment, the ratio is designed with consideration of a recovery amount from an elastic deformation of the filament wire material.

The reason for fixing the rotational speed ratio is to maintain a twisting pitch of a product (the cord 20) at a predetermined ratio, even if the twister 22 is a simple device with no need of control. However, by making the ratio changeable or driving the two shafts separately to set any desired rotation speed, it is possible to freely change the twisting pitch. With such structures, the twisting pitch can be altered according to each intended portion of a tire. This enables to adjust characteristics of a tire by altering a twisting pitch of a single continuous cord member.

Conventionally, use of a cord, which is produced with a twister having such a variable pitch function, in a tire has been very difficult. Therefore, in order to make the best use of the advantage of the present invention, it is preferable to locate the twister in the vicinity of tire members or in the vicinity of an apparatus for producing a tire, in view of facilitating alignment of cords with proportions of the tire where the cords are intended to be used. Further, it is desirable to make the twister operable in combination with the apparatus for producing a tire.

A type of a cord that can be produced with the twister 22 is not limited to a steel cord, and cords made of organic fiber materials can also be produced, and similar effects can be obtained therefrom. Further, any of a composite formed by twisting a cord and an organic fiber, a composite formed by twisting a cord and a string-like rubber, a composite formed by twisting a cord, an organic fiber and a string-like rubber can be produced, such that reinforcing materials that meet required tire qualities can be provided.

As described above, in the present embodiment, the rotating body 30 is provided with the rotation-driving shaft 40 for rotatably driving the entire rotating body, and the feed-driving shaft member 50 supported by the bearing section 51 coaxially with the rotation-driving shaft 40. These two shafts are rotatably driven by the single motor 34. Thus, the structure of the twister 22 can be made significantly simple. It should be noted that rotating body 30 may be provided with an electric motor, or the like, for generating a force for driving the feeding mechanism 58. However, in the present embodiment, in order to make the device simpler, the feed-driving shaft is disposed coaxially with the rotation axis of the rotating body 30, to drive the feeding mechanism 58 in the rotating body 30.

Further, since the cord 20 is pulled out from the twisting point forming section 28 by the multi-winding capstan 68 and the multi-winding pulley 72 to discharge the cord 20 from the rotating body 30, it is not necessary to press the cord 20 with the pinch roller 70 with a large force. Moreover, since the winding directions of the multi-winding capstan 68 and the multi-winding dummy pulley 72 are opposite from each other, and it is not necessary to take up the cord 20 on a reel, the cord 20 with significantly improved straightness can be produced.

It should be noted that, although the present embodiment has been described with the example where the twister 22 is disposed downstream of the twisting point forming section 28, it is possible that the twister 22 is disposed upstream of the twisting point forming section 28, short filament wires that have been cut in advance are fed to the twister 22, and then, a twisted wire is pulled out from the twisting point forming section 28.

Example Experiment

Comparative data obtained by an experiment on rotating property and straightness of a cord of 1×3×0.30 structure produced with the twister 22 according to the first embodiment and rotating property and straightness of a cord of 1×3×0.30 structure produced with a conventionally used buncher-type twister are shown in Table 1.

TABLE 1

| | Cord rotating property (times/6 m) | | Cord straightness (mm/300 mm) | |
|---|---|---|---|---|
| | Cord produced with conventional twister | Cord produced with twister of first embodiment | Cord produced with conventional twister | Cord produced with twister of first embodiment |
| n number | 1920 | 20 | 600 | 20 |
| Average | 0 | 0 | 9.02 | 0 |
| Standard deviation | 0.43 | 0 | 3.02 | 0 |

The average and the degree of dispersion of rotating property and those of straightness of the cord produced with the twister 22, which are theoretically zero, are also confined to be zero in the experiment data of the present example.

Accordingly, it is understood that products of ideal quality can be provided in continuous and stable manner in the invention.

Since the average and the degree of dispersion of the rotating property and those of straightness of the cord were zero, there occurred neither torsion nor warpage in a treat of the tire reinforcing material where cords were embedded in a barred lattice pattern, and a completely flat treat was produced. Thus, it was found that deterioration of operational efficiency at tire factories due to torsion and warpage in treats can be completely eliminated, and tire performances such as uniformity can be improved.

Second Embodiment

Next, a second embodiment will be described. In the second embodiment, components that are the same as those of the first embodiment are assigned with the same reference numeral and explanations thereof are omitted.

Figure 3:
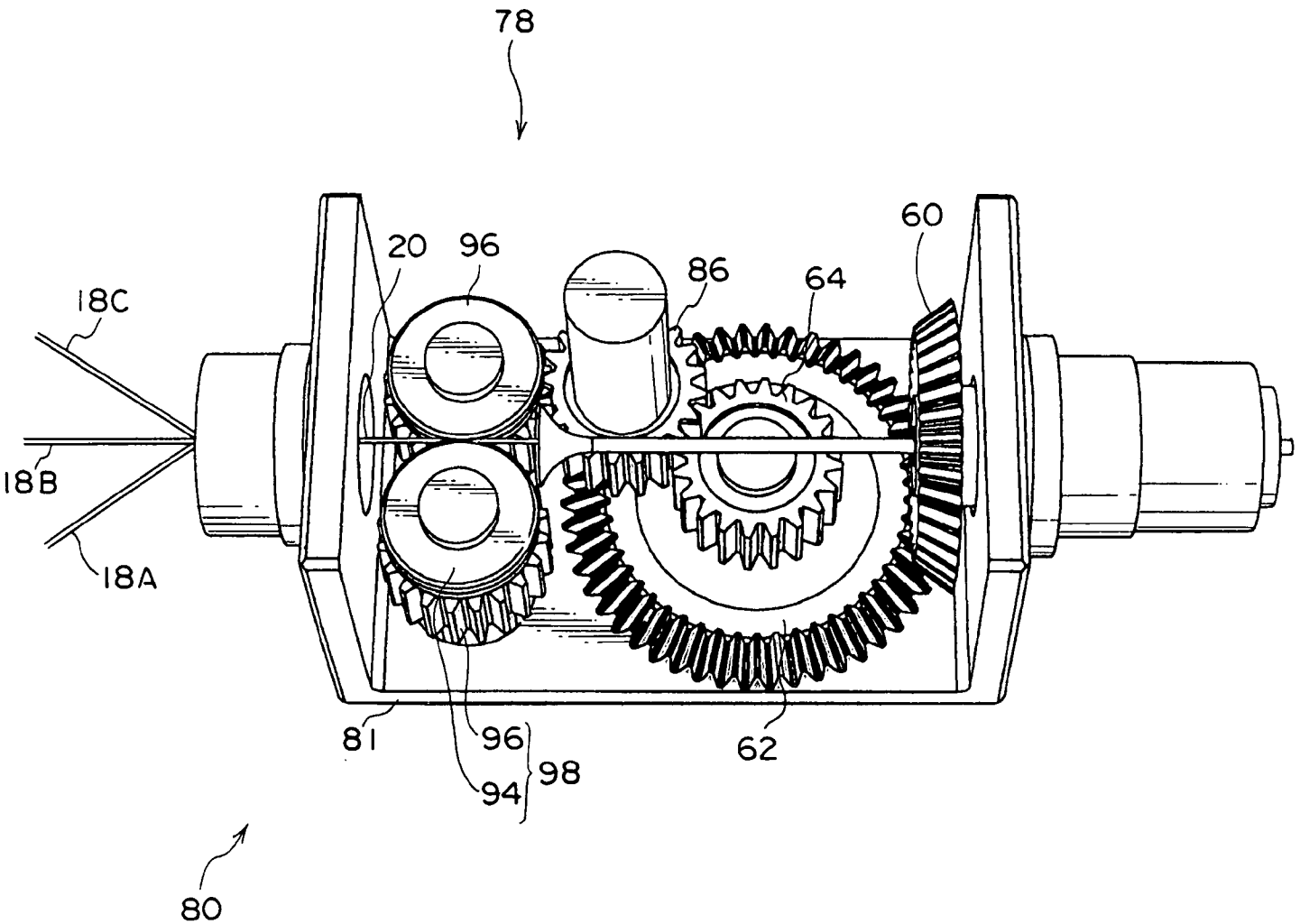
FIG. 3 is a perspective view illustrating a structure of a rotating body of a twister of a second embodiment.
Figure 4:
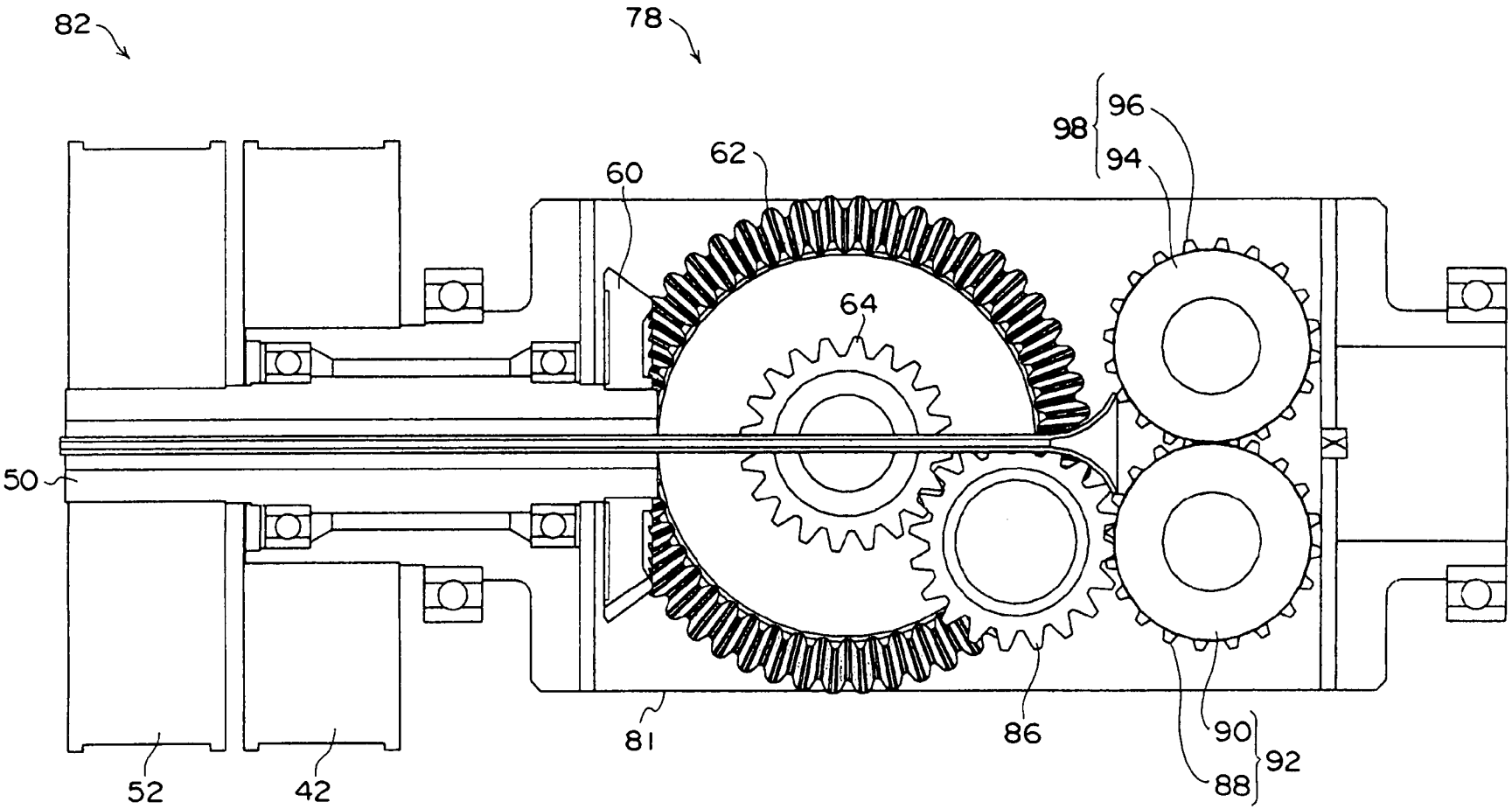
FIG. 4 is a perspective sectional view illustrating a structure of the rotating body of the twister of the second embodiment.
Figure 5:
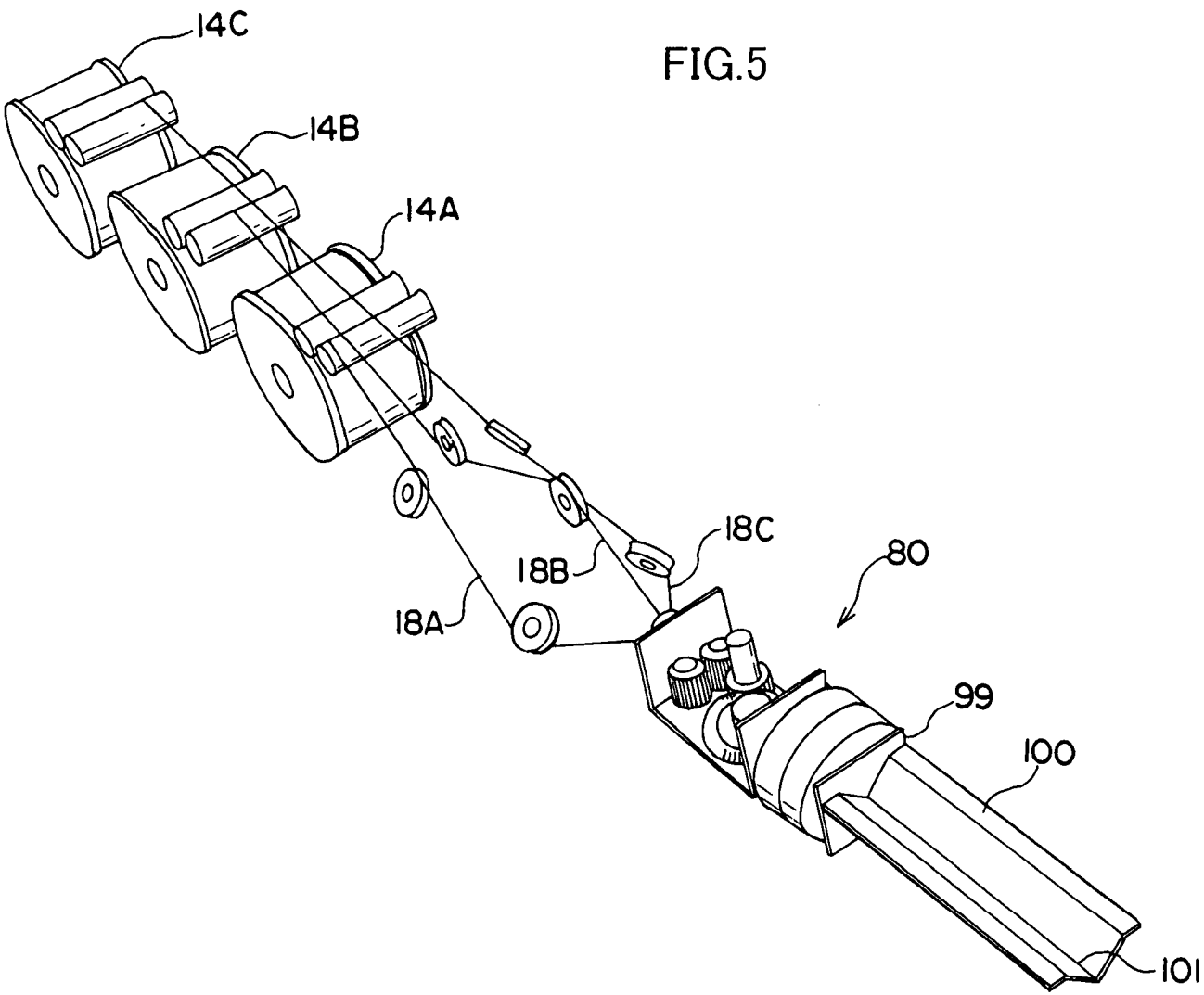
FIG. 5 is a perspective view illustrating that the twister of the second embodiment is disposed in a twisted wire production line.

As shown in FIGS. 3 to 5, a twister 82 according to the second embodiment is different from the twister of the first embodiment in a structure and operation of a feeding mechanism 78 provided in a rotating body 80. Namely, in place of the pinch roller 70, the multi-winding capstan 68, and the multi-winding dummy pulley 72 (see FIG. 2), an intermediate gear 86 meshing with the small gear portion 64; a first feeding roller 92 that has a first feeding gear portion 88 meshing with the intermediate gear 86 and also has a first pinch roller portion 90; and a second feeding roller 98 that has a second feeding gear portion 96 meshing with the first feeding gear portion 88 and also has a second pinch roller portion 94, are disposed in a frame member 81 of the rotating body 80.

The first pinch roller portion 90 and the second pinch roller portion 94 are in contact with each other so as to press against each other, and they nip the plural filament wires 18A to 18C therebetween.

The twister 82 is further provided with a cutter 99 (see FIG. 5) at a downstream side of the feed-driving pulley 52 to cut the cord to a predetermined length. A receiving section 100 for receiving the cut cords is disposed downstream of the cutter 99. The receiving section 100 has a depression 101 formed at a center thereof along a feed direction of the cord. The receiving section 100 is optional.

In the twister 82 according to the second embodiment, rotation of the motor rotates the rotating body 80 and the feed-driving shaft member 50, and a torque is sequentially transmitted to the first gear 60, the second gear 62, the intermediate gear 86, the first feeding roller 92 and the second feeding roller 98. As a result, a feeding force is applied to the filament wires 18A to 18C nipped between the first pinch roller portion 90 and the second pinch roller portion 94. Therefore, the filament wires 18A to 18C are twisted together and the resulting twisted cord 20 is discharged to a downstream side of the rotating body 80.

As described above, in the second embodiment, in place of the multi-winding capstan 68 and the multi-winding dummy pulley 72 (see FIG. 2), the first feeding roller 92 and the second feeding roller 98 having a diameter smaller than the multi-winding capstan 68 and the multi-winding dummy pulley 72, respectively, are disposed in the frame member 81 of the rotating body 80. This allows further reduction of a size of the rotating body 80.

Third Embodiment

Figure 6:
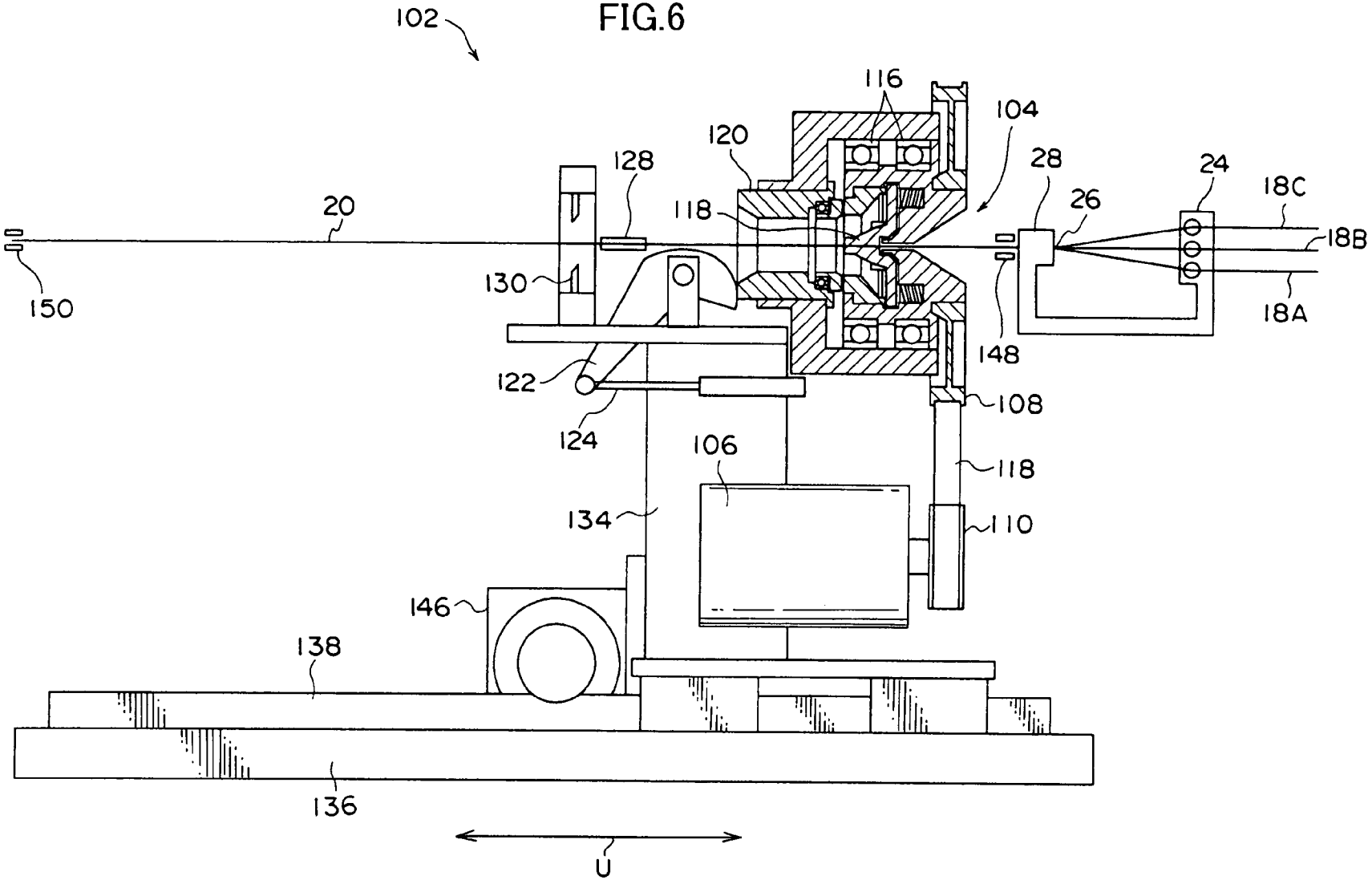
FIG. 6 is a sectional side view illustrating a twister of a third embodiment.

Next, a third embodiment will be described. As shown in FIG. 6, a twister 102 according to the third embodiment includes the preforming section 24 and the twisting point forming section 28, similarly to the first embodiment, as well as a rotating chuck 104 disposed downstream of the twisting point forming section 28 and a motor 106 for providing a torque to the rotating chuck 104. A rotating chuck driving pulley 108 is provided at the rotating chuck 104, and a turntable 110 is provided at the motor 106. An endless belt 118 is supported around the rotating chuck driving pulley 108 and the turntable 110. The rotating chuck 104 is rotatably supported by a bearing section 116.

The rotating chuck 104 includes a chucking portion 118 for chucking the cord 20 pulled out from the twisting point forming section 26, and a piston-like releasing portion 120 for switching between a gripping state and a releasing state of the chucking portion 118. Further, the twister 102 includes a lever portion 122 for transmitting a moving force to the releasing portion 120 and a releasing piston portion 124 for transmitting a driving force to the lever portion 122 when chucking is released. The twister 102 further includes a guide pipe 128 for guiding the cord 20 toward a downstream side of the rotating chuck 104, and a cutter 130 for cutting the cord 20 discharged from the guide pipe 128.

Moreover, the twister 102 includes: a slide bearing rail 136 for supporting a mount 134, which supports the rotating chuck 104 and the motor 106; a rack gear 138; and a mount-moving motor 146. The slide bearing rail 136 supports the mount 134 such that the mount 134 can move along a cord feeding direction U. The twister 102 further includes a chucking portion 148 between the twisting point forming section 28 and the rotating chuck 104 as well as a chucking portion 150 in the vicinity of an rear end of the slide bearing rail 136, for removably chucking the cord 20.

In order to produce the cord 20 with the twister 102, the chucking portions 148 and 150 are set in the releasing state and the rotating chuck 104 is set in the gripping state, and the motor 106 is rotated to rotate the rotating chuck 104 to twist the filament wires 18A to 18C. At the same time, the mount-moving motor 146 is rotated to move the mount 134 backward at a predetermined speed. In this manner, the filament wires 18A to 18C are twisted into the single cord 20 and the cord 20 is pulled out from the twisting point forming section 28.

In a state where the cord 20 is pulled out by a necessary length, the chucks 148 and 150 are set in the gripping state and the rotating chuck 104 is set in the releasing state, and then, the mount 134 is returned to its original position. As a result, the cord 20 is discharged from the rotating chuck 104 by a necessary length, and then is cut by the cutter 130 to obtain pieces of the cord 20 having necessary lengths.

In the third embodiment, the motor 106 for rotating the rotating chuck 104 and the mount-moving motor 146 for moving the mount 134 are driven independently from each other. Therefore, the twister 102 having a simple structure is realized, with which multi-line cords 20 having various lengths and various twisting point pitches can be produced as desired.

When the rotating chuck 104 is set in the gripping state and moved backward, the speed of the backward movement may be changed during the movement. In this manner, a twisting pitch can be partially changed within a single cord.

Fourth Embodiment

Figure 7:
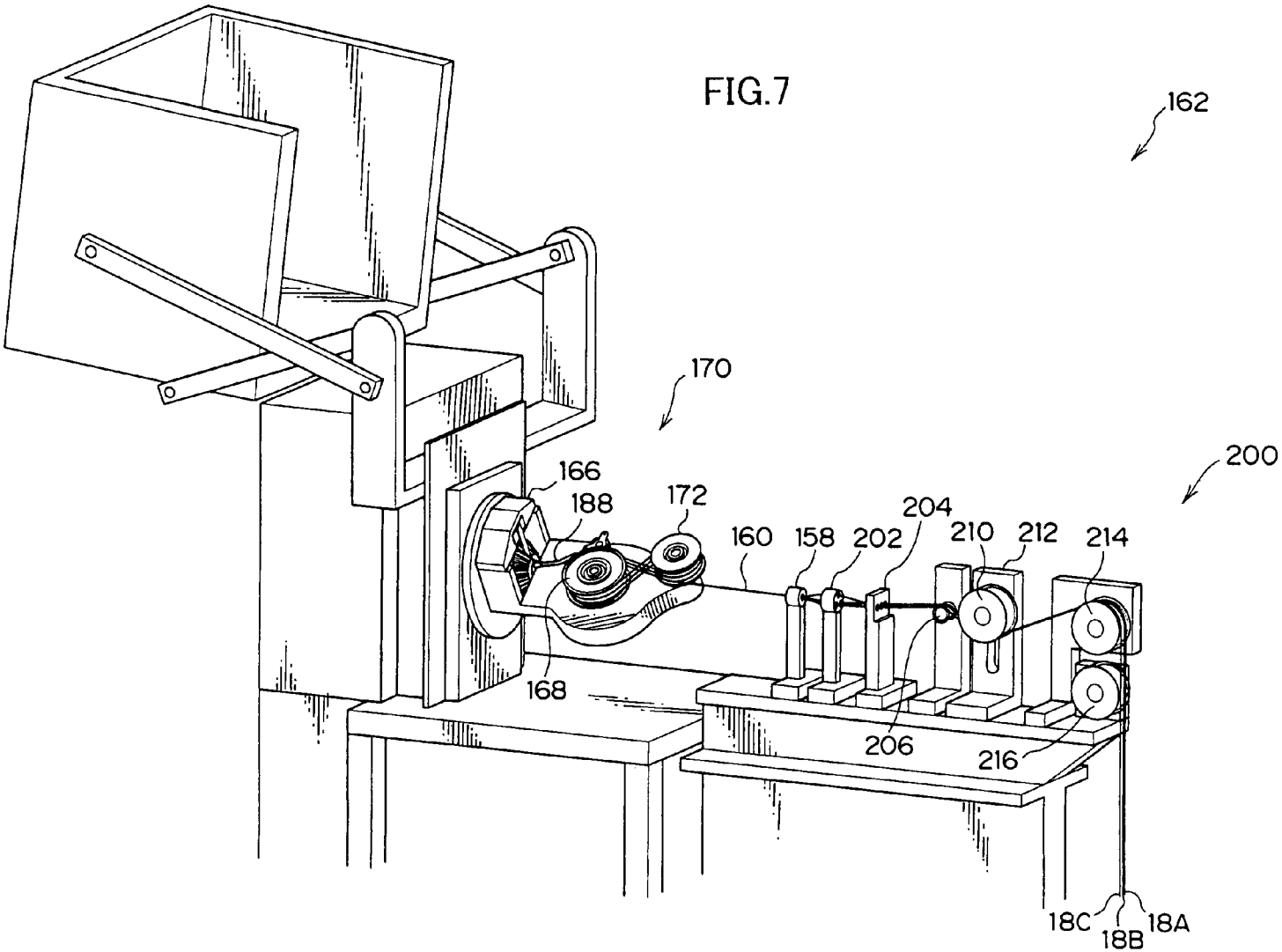
FIG. 7 is a perspective view illustrating a twister of a fourth embodiment.

Next, a fourth embodiment will be described. FIG. 7 is a perspective view of a twister 162 according to the fourth embodiment. In the fourth embodiment, components that are the same as those of the first embodiment are assigned with the same reference numeral and explanations thereof are omitted.

Rotating Body

Figure 8:
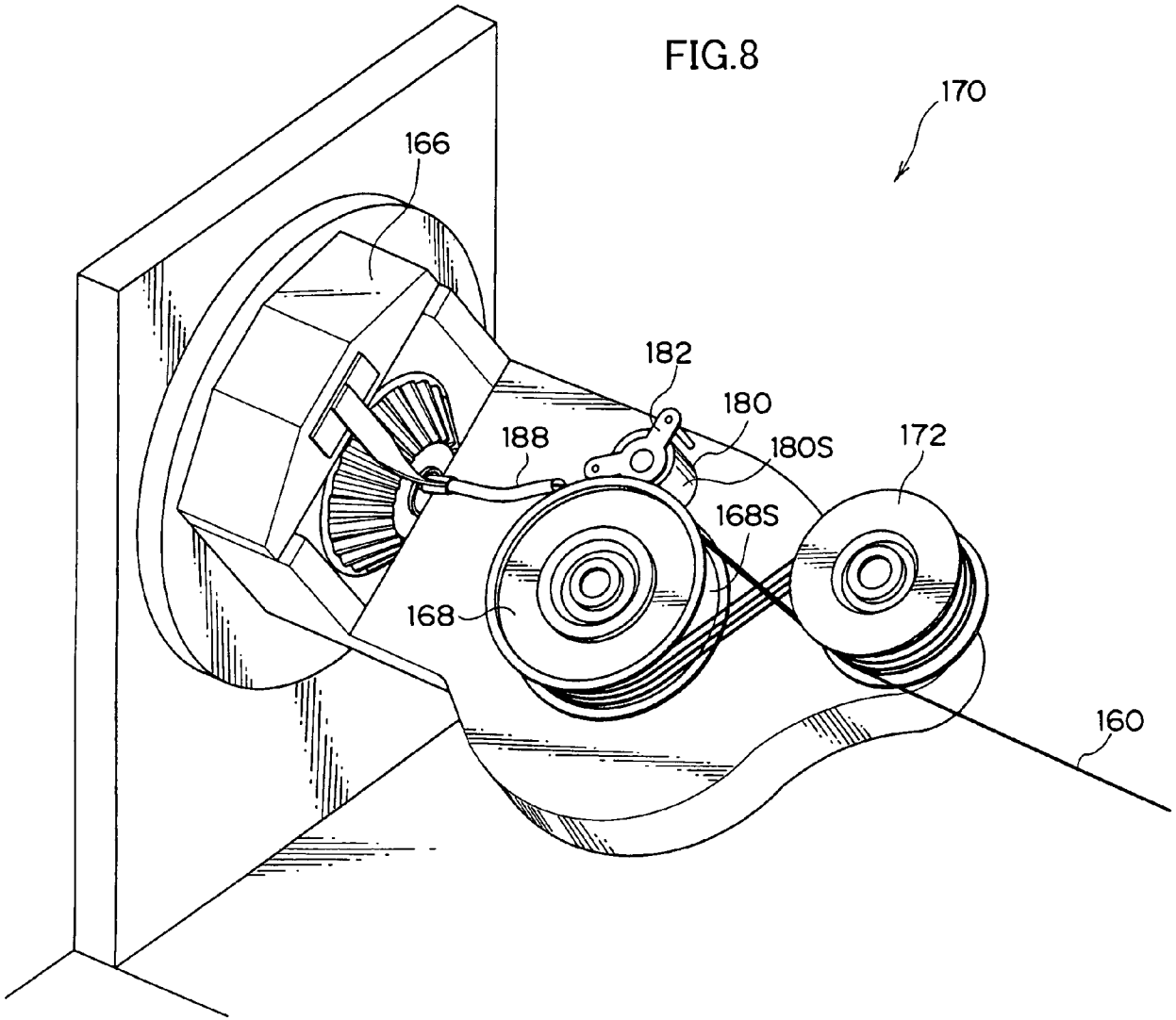
FIG. 8 is a perspective view illustrating a rotating body forming the twister of the fourth embodiment.

As shown in FIG. 8, the twister 162 of the fourth embodiment includes, in place of the rotating body 30 of the first embodiment (see FIG. 1), a rotating body 170 disposed downstream of twisting point forming section 158, the rotating body 170 being rotatably supported at a site thereof at a side where a cord 160 is discharged.

In the present embodiment, the cord 160 pulled out from the twisting point forming section 158 is wound on an outer circumference of a multi-winding dummy pulley 172 and then on a multi-winding capstan 168 alternately for several times.

Since the cord 160 enters along a rotation center axis of the rotating body 170, the multi-winding pulley 172, on which the cord 160 is wound first, is disposed such that the outer circumference thereof is in contact with the rotation center axis of the rotating body 170. In the first embodiment, the twisted cord 20 is first wound on the multi-winding capstan 168, and therefore, the outer circumference of the multi-winding capstan 168 is positioned to be in contact with the rotation center axis of the rotating body 30. However, since the multi-winding pulley 172 without a driving section therefor can more easily reduce size and weight thereof than the multi-winding capstan 168, an influence of a centrifugal force in a case where the multi-winding pulley 172 is offset by a radial length thereof can be made smaller.

In this structure, a moment of inertia of the rotating body 170 about rotation center axis is significantly smaller than that in the first embodiment, and therefore, the rotating body 170 having good durability to high speed rotation can be obtained. If a bending pulley is introduced to change a path of the cord 160, a weight and a size of the rotating body is increased. Therefore, the aforementioned effect of the present embodiment is critical.

It should be noted that positioning of parts of the rotating body 170 is determined through 3D calculations so that a weight for balancing the rotation is minimized, that is, a center of gravity is positioned on the rotation center axis. Further, a balance weight 166 may be provided, as necessary. This makes the above effect even more remarkable.

In addition, the rotating body 170 is not provided with a housing. Therefore, a distance between the twisting point forming section 158 and the rotating body 170 can be made smaller than that in the first embodiment, and it is possible to reduce the distance as best as possible. Thus, when the cord 160 is produced with the twisting pitch thereof being changed during production, changes in an actual shape (a twisting pitch) of the cord 160 can well reflect changes in a rotation frequency provided at the twister 162.

In a method of producing a twisted wire using this mechanism, a cord is formed by applying, to the cord 160 in a section between the twisting point forming section 158 and the rotating body 170, a torsional deformation exceeding a torsional yield point of each filament wire material, to cause plastic deformation. Therefore, in the section between the twisting point forming section 158 and the rotating body 170, the torsion of the cord 160 is propagated and averaged. Accordingly, in a case where the rotation frequency of the rotating body 170 is changed to change the twisting pitch during production of a single cord, a longer distance between the twisting point forming section 158 and the rotating body 170 results in a longer influential range where the torsion is propagated and averaged, and a problem arises, that the changes in the twisting pitch of the cord 160 cannot catch up with a speed of changes in the rotation frequency of the rotating body 170. Therefore, by reducing the distance between the twisting point forming section 158 and the rotating body 170 as best as possible, as in the fourth embodiment, changes in the actual shape (the twisting pitch) of the cord 160 can more faithfully reflect the changes in the rotation frequency of the rotating body 170.

Further, the rotating body 170 is provided with a pressure roller 180 for pressing the cord 160 against the multi-winding capstan 168, and a pressure roller supporting device 182 for pressing the pressure roller 180 toward the multi-winding capstan 168 and rotatably supporting the pressure roller 180. The cord 160 discharged from the multi-winding capstan 168 is pressed against an outer circumferential surface 168S of the multi-winding capstan 168 by an outer circumferential surface 180S of the pressure roller 180 with a constant pressing force (see FIG. 9). The pressing force of the pressure roller 180 applied to the cord 160 by the pressure roller supporting device 182 can be set constant.

The outer circumferential surface 168S of the multi-winding capstan 168 is formed in a shape of a cylinder side surface. The cord wound on the multi-winding capstan 168 at a topmost position thereof is drawn into an exiting-wire guide pipe 188 provided in the rotating body 170, and is discharged from the rotating body 170 at a discharging side thereof. In order to bring the cord 160 at the topmost position of the multi-winding capstan 168 to a position where the cord 160 is easily guided into the exiting-wire guide pipe 188, the outer circumferential surface 180S of the pressure roller 180 has an annular projection 181 (see FIG. 9), and the cord 160 wound on the multi-winding capstan 168 at the topmost position thereof is positioned between the projection 181 and an upper rim 168F of the multi-winding capstan 168.

Figure 9:
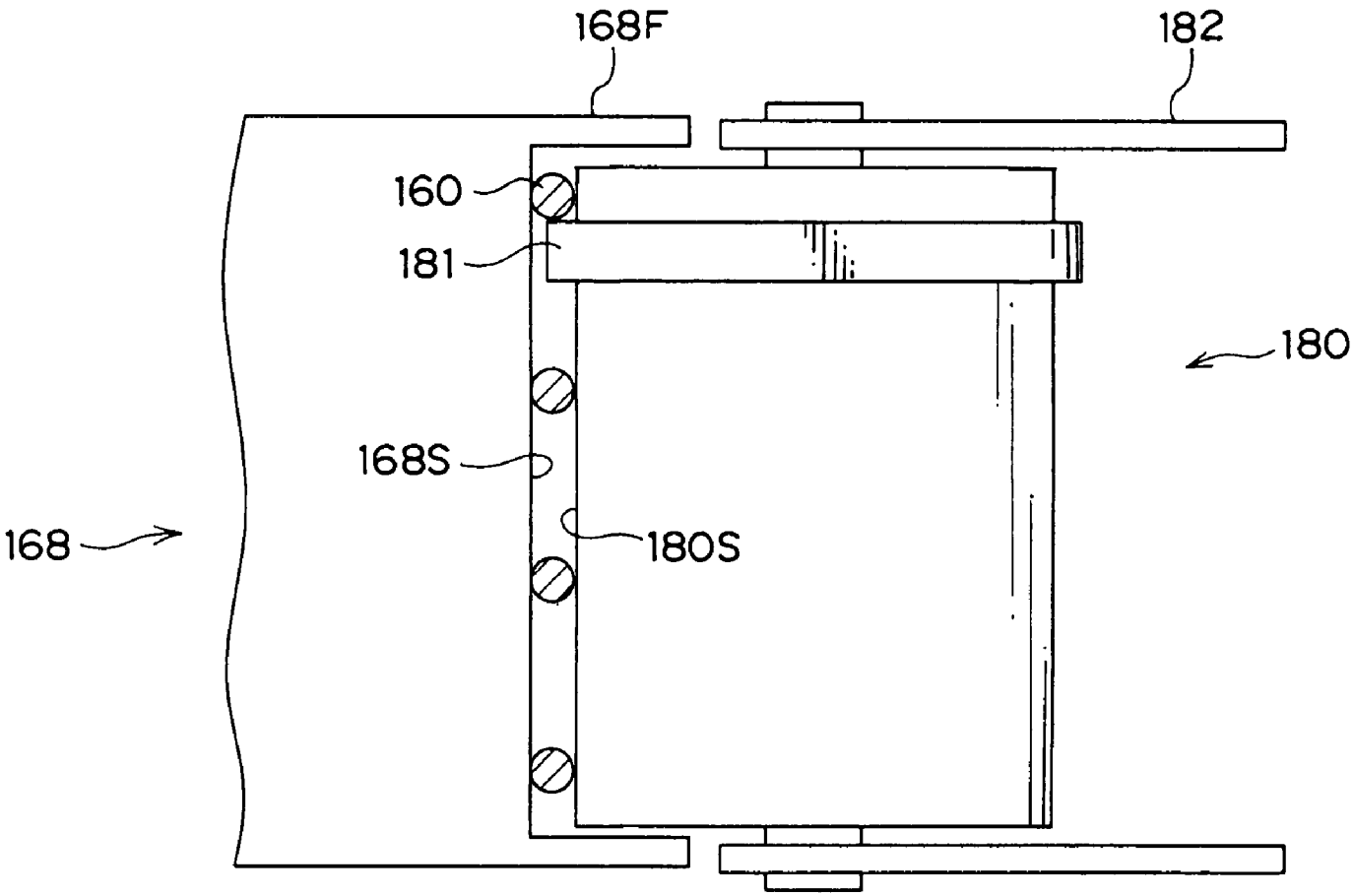
FIG. 9 is a side view illustrating that a cord is pressed by a multi-winding capstan and a pressure roller forming the rotating body in the fourth embodiment.

Although the projection 181 is formed only for the topmost cord position in FIG. 9, such a projection can be formed for each cord position. Alternatively, a similar effect can be obtained by providing a groove in the multi-winding capstan 168, instead of providing the outer circumferential surface 180S of the pressure roller 180 with the projection 181.

The pressure roller 180 is formed to accept dimensional errors in the multi-winding capstan 168 and the pressure roller 180, and to allow passage of the cord 160 without damaging nodal sites of the cord 160. In addition, the pressure roller 180 can be attached to and removed from the pressure roller supporting device 182 through a single simple operation, and therefore, it is easy to pass the cord 160 through between the multi-winding capstan 168 and the pressure roller 180. Moreover, the pressure roller is structured such that the pressing force thereof does not decrease due to vibration or a centrifugal force. Furthermore, since the pressure roller 180 is provided on the rotating body 170, a centrifugal force is exerted to the pressure roller 180, similarly to the multi-winding capstan 168 and the other parts. However, by setting an extending/retracting direction and a supporting direction of the pressure roller 180 so as to avoid an influence of the centrifugal force, change in the pressing force due to rotation of the rotating body 170 is prevented.

Since the wire material for the cord 160 and the like has a strong elastic force, when it is twisted, it accumulates a force to twist back. Therefore, when clamping of the wire material is released, the wire material springs back in a direction opposite to the twisting direction. In order to obtain a uniform quality of the cord in the longitudinal direction thereof, it is necessary to cause the cord to spring back stable and uniform over the longitudinal direction thereof.

In the present embodiment, by pressing the cord 160 by the multi-winding capstan 168 and the pressure roller 180 with a constant set force, a tension of the cord 160 between the twisting point forming section 158 and an exit from the multi-winding capstan 168 is set at a constant value. Further, the outer circumferential surface 168S of the multi-winding capstan 168 and the outer circumferential surface 180S of the pressure roller 180 are formed to have a shape of a cylinder side surface and the cord 160 is pressed by a flat-bottom groove, to increase a contact surface between the groove bottom and the pressed cord 160 in a direction perpendicular to the cord 160.

This makes twisting back (springing back) of the cord 160 continuous and stable over the longitudinal direction thereof.

Driving Motor

Figure 12:
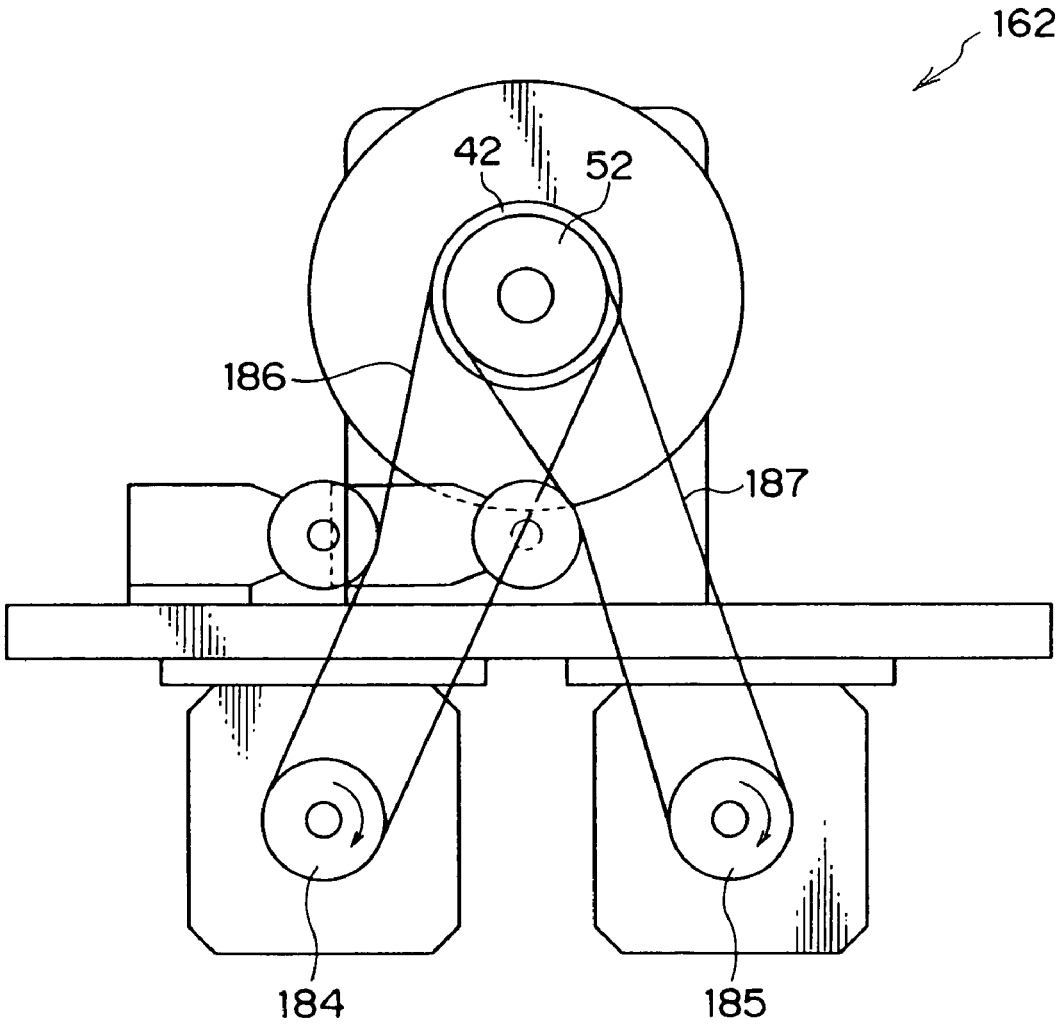
FIG. 12 is a structural diagram illustrating a side of the twister of the fourth embodiment, at which side a cord is discharged.

As shown in FIG. 12, the twister 162 includes a rotation-driving motor 184 for rotating the rotation-driving pulley 42 and a feed-driving motor 185 for rotating the feed-driving pulley 52, in place of the motor 34 (see FIG. 1) in the first embodiment. An endless belt 186 is supported around the rotation-driving pulley 42 and the rotation-driving motor 184, and an endless belt 187 is supported around the feed-driving pulley 52 and the feed-driving motor 185.

The multi-winding capstan 168 is driven, via a driving gear (not shown), by a drive input shaft (not shown) disposed at a position of a rotational axis of the rotating body 170. Therefore, a rotational speed of the multi-winding capstan 168 is determined by a difference between a rotation frequency of the rotating body 170 and a rotation frequency of the drive input shaft, i.e., by a relative rotation frequency.

On the other hand, a feeding speed of the cord 160 is determined by a rotational speed of the multi-winding capstan 168, and a twisting speed of the cord 160 is determined by a rotational speed of the rotating body 170. Therefore, as in the present embodiment, by providing the rotation-driving motor 184 and the feed-driving motor 185 independently from each other, and changing a ratio of rotation frequencies, i.e., a shaft speed ratio between these two motors during production of a cord, a twisting pitch of the cord can be freely changed in the midway of the cord. It should be noted that the twister 162 includes a controlling section (not shown) including a computer program for calculating and controlling rotation frequencies of the rotation-driving motor 184 and the feed-driving motor 185, so that the twisting pitch can be switched between desired pitches with the feeding speed of the cord 160 kept constant.

An operation with a variable twisting pitch can be carried out without keeping the feeding speed of the cord 160 constant. However, a feed amount of each filament wire material is stabilized under an operation with a constant feeding speed, so that a tension of each filament wire material can be controlled in a easy and stable manner.

Preforming Section

As shown in FIG. 7, the twister 162 includes hole guides 202 and 204 sequentially disposed upstream of the twisting point forming section 158, for respectively passing the three filament wires 18 therethrough, and a preforming section 200 for preforming the filament wires 18 disposed upstream of the hole guide 204.

The preforming section 200 includes a preforming roll 206 for preforming the three filament wires 18A to 18C. The preforming section 200 further includes an incidence angle adjusting pulley 210 disposed upstream of the preforming roll 206, and a pulley position adjuster 212. The incidence angle adjusting pulley 210 contacts the filament wires 18A to 18C at a lower portion of the outer circumferential surface thereof to adjust an incidence angle of the filament wires 18A to 18C to the preforming roll 206. The pulley position adjuster 212 supports the incidence angle adjusting pulley 210 so as to be movable in a vertical direction that is substantially perpendicular to the feeding direction of the filament wires 18A to 18C.

The preforming section 200 further includes a guide pulley 214 disposed upstream of the incidence angle adjusting pulley 210. In addition, a wire-speed detection pulley 216 for detecting a feeding speed of the filament wires 18 is disposed upstream of the guide pulley 214.

In this structure, the incidence angle to the preforming roll 206 can be adjusted by adjusting a position of the incidence angle adjusting pulley 210 in the vertical direction.

Figure 10:
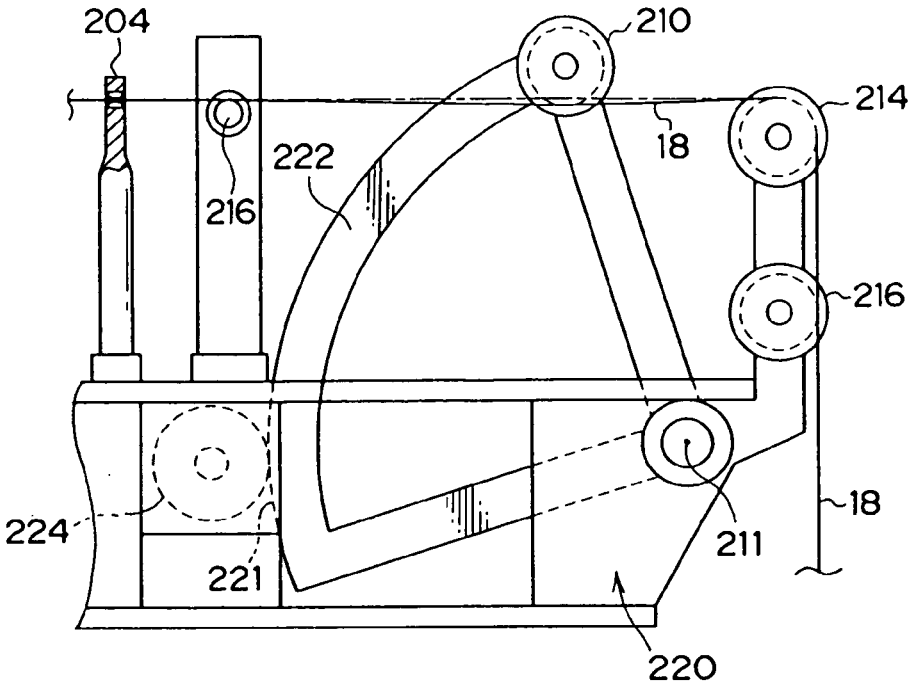
FIG. 10 is a structural diagram illustrating a modification of a preforming section of the twister of the fourth embodiment.
Figure 11:
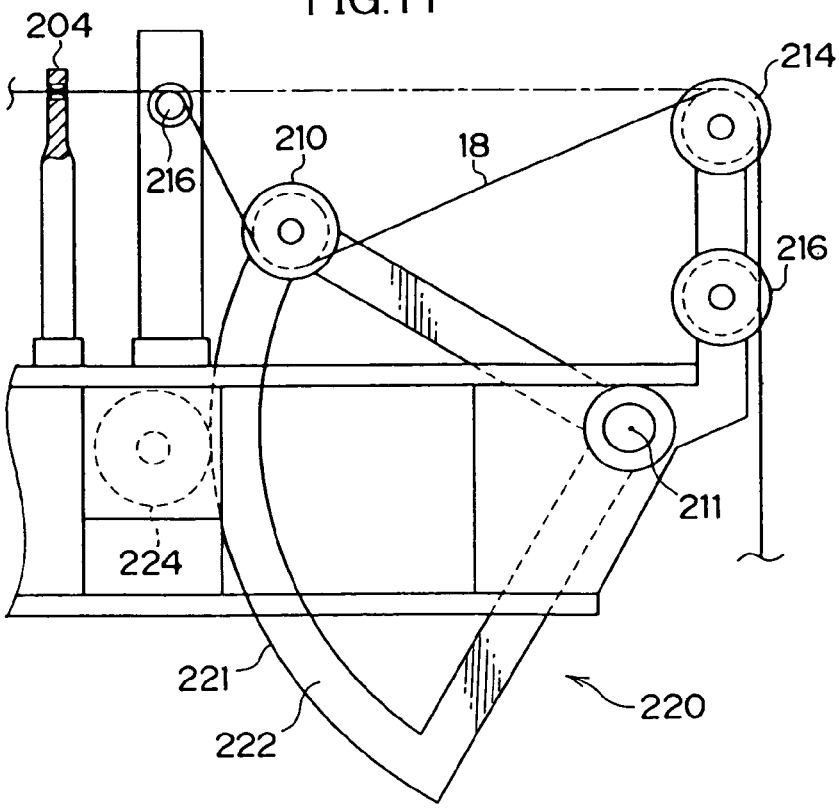
FIG. 11 is a structural diagram illustrating a modification of the preforming section of the twister of the fourth embodiment.

In place of the pulley position adjuster 212, a pulley holding section 220, as shown in FIGS. 10 and 11, may be included. The pulley holding section 220 has a sectoral contour, rotatably supports the incidence angle adjusting pulley 210 at an upper end thereof, and is pivotable about a pivot center 211. In this case, a circular arc outline portion 222 including a driven gear 221 formed at an outer circumference thereof is provided at the pulley holding section 220. Further, a driving gear 224 meshing with the driven gear 221 and a driving gear motor (not shown) for driving the driving gear 224 are provided at the preforming section. When the twister is in operation, a position of the incidence angle adjusting pulley 210 can be precisely adjusted by controlling the driving gear motor. This makes it possible to process the cord with a desired amount of preforming being applied thereto, and thus a cord having degree of preforming continuously adjusted can be produced.

Cutter

The twister 162 further includes a cutter (not shown) for cutting the cord 160 discharged from the rotating body 170 to a constant set length.

The cutter includes a blade that moves toward the cord 160, a spring for urging the blade, and a motor or an actuator (none of which is shown) for compressing the spring. The spring compressed by the motor or actuator accumulates energy, and when the compressed spring is released, the blade is moved immediately to cut the cord 160.

In this manner, the cord 160 can be cut with the cutter to a desired set length, thereby increasing degree of freedom in design conditions and production conditions for tires. Further, since a moving speed of the blade is increased using a spring, the cutter can be made small enough.

As an example of high-speed of the blade, it takes $^{20}/_{1000}$ second from a time of instruction of cutting to a time when the blade movement has stopped, and a cutting operation takes $^{5}/_{1000}$ second. As a time interval between each cutting operation is usually one second, and there is an enough time to compress the spring.

It should be noted that, without using a spring, the cord 160 can also be cut to a constant set length by providing a mechanism for moving the blade position at the same speed as the feeding speed of the cord 160.

As described above, in the present embodiment, a moment of inertia of the rotating body 170 about the rotation center axis is significantly smaller than that in the first embodiment. Therefore, a centrifugal force exerted on the bearing of the multi-winding capstan 168 is reduced, so that the rotating body 170 that exhibits good durability for high speed rotation can be obtained.

Further, the rotation-driving motor 184 for rotating the rotation-driving pulley 42 and the feed-driving motor 185 for rotating the feed-driving pulley 52 are provided for separately driving the rotation-driving pulley 42 and the feed-driving motor 185. Therefore, a feeding speed and a pitch of the cord 160 can be separately controlled by changing rotational speeds of the motors.

Yet further, since the rotating body 170 is not provide with a housing such as in the first embodiment, the twisting point can be positioned nearer to the multi-winding capstan 168 and the multi-winding dummy pulley 172 than in the first embodiment. Since a distance from the twisting point to a point of winding by the rotating body 170 is shorter than in the first embodiment accordingly, when a rotation frequency of the rotating body 170 is changed, a change in a twisting pitch of the actually processed cord 160 can well reflect the change in rotation frequency of the rotating body 170.

Moreover, the driving gear (not shown) for driving the multi-winding capstan 168 is made of a resin that has a lubrication effect by itself. This renders unnecessary using a grease or an oil for lubrication. Therefore, there arises no problem in lubricity even when a centrifugal force is generated at the driving gear due to the rotation of the rotating body 170. Further, a great effect can be obtained in size and weight reduction of the rotating body 170.

It should be noted that plural cords 160 may be produced simultaneously by arranging plural sets of components other than the rotating body 170, the preforming section 200, the cutter or the like, the rotation-driving motor 184 and the feed-driving motor 185, and using a common rotation-driving motor 184 and a common feed-driving motor 185. Plural cords can thus be produced with a more compact system. In this case, in order to arrange cords at appropriate intervals at a production site of pneumatic tires, a tube guide for guiding cords from the rotating body 170 may be provided. In this manner, pneumatic tires can be efficiently produced.

Fifth Embodiment

Next, a fifth embodiment will be described. In the present embodiment, a cord made of steel (steel cord) is produced as described in the first embodiment, and the steel cord is cut to a predetermined length to make cord pieces 21 (see FIGS. 14 and 16), and a belt ply with the cord pieces 21 embedded therein is produced. The belt ply is used to produce a pneumatic tire.

Figure 13:
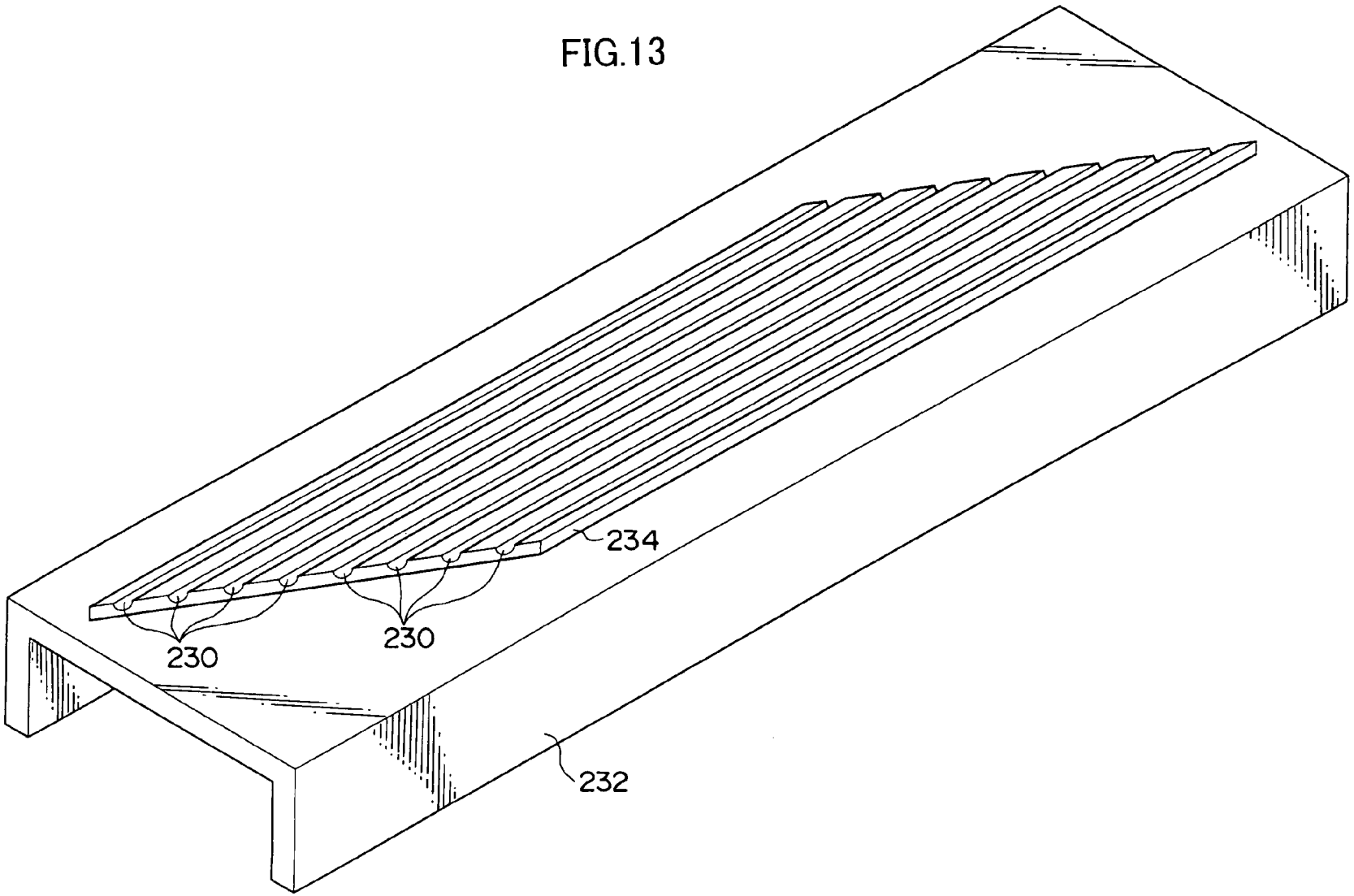
FIG. 13 is a perspective view illustrating a cord piece table used in a fifth embodiment.

In the present embodiment, a cord piece table 232 including multiple grooves 230 formed therein for aligning the cord pieces 21 in parallel with each other, as shown in FIG. 13, is prepared in advance. A projection 234, which is rhomboidal when viewed from above, is formed at the cord piece table 232, and the multiple grooves 230 are formed in an upper surface of the projection 234. A length of each groove 230 is the same as a length of each cord piece 21, and each groove 230 is open at both ends thereof. A shape of the projection 234 when viewed from above is determined with consideration of a shape of a belt piece 236 (see FIG. 17). Further, the projection 234 includes a magnet (not shown) embedded therein for attracting the cord pieces 21 with a magnetic force.

Figure 14:
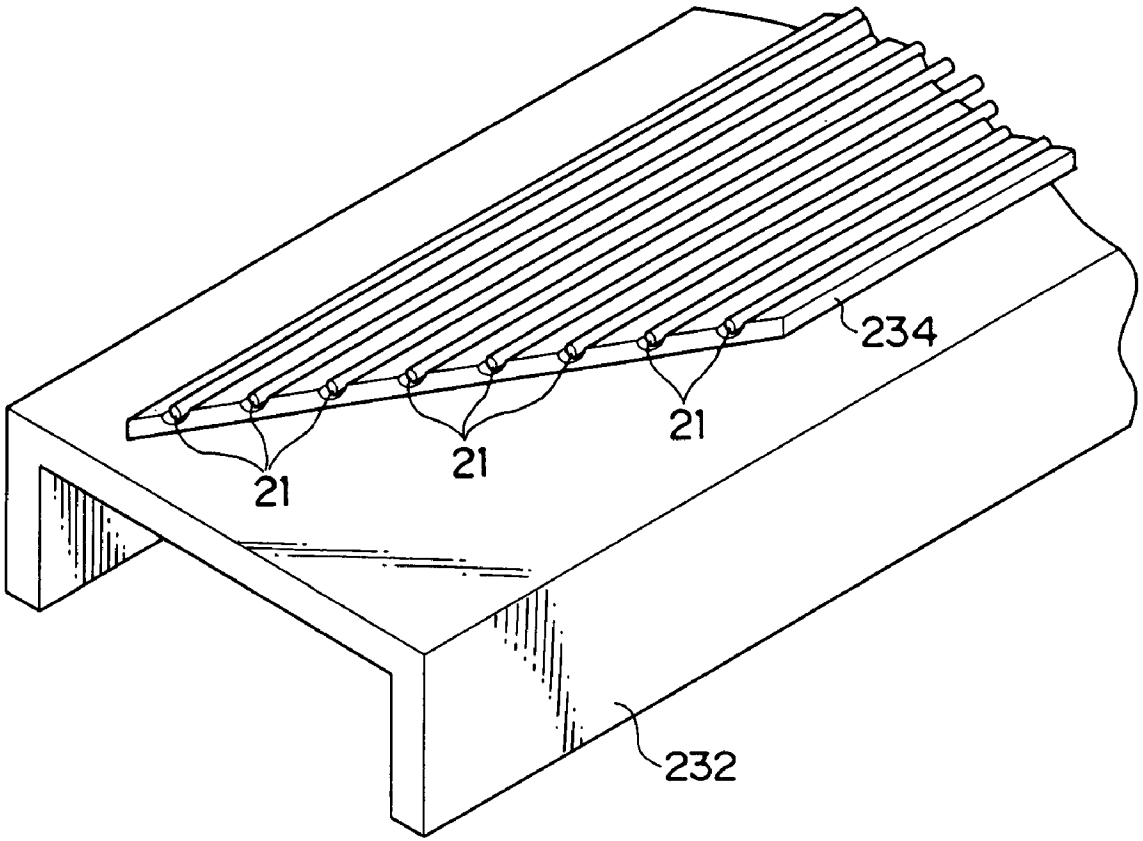
FIG. 14 is a partial perspective view illustrating that cord pieces are placed on the cord piece table used in the fifth embodiment.

To produce a pneumatic tire of the present embodiment, first, as shown in FIG. 14, the cord pieces 21 cut to a predetermined length are placed in the grooves 230 in the projection 234. As a result, the cord pieces 21 are held at groove bottoms of the projection 234 by the magnet (not shown).

Figure 15:
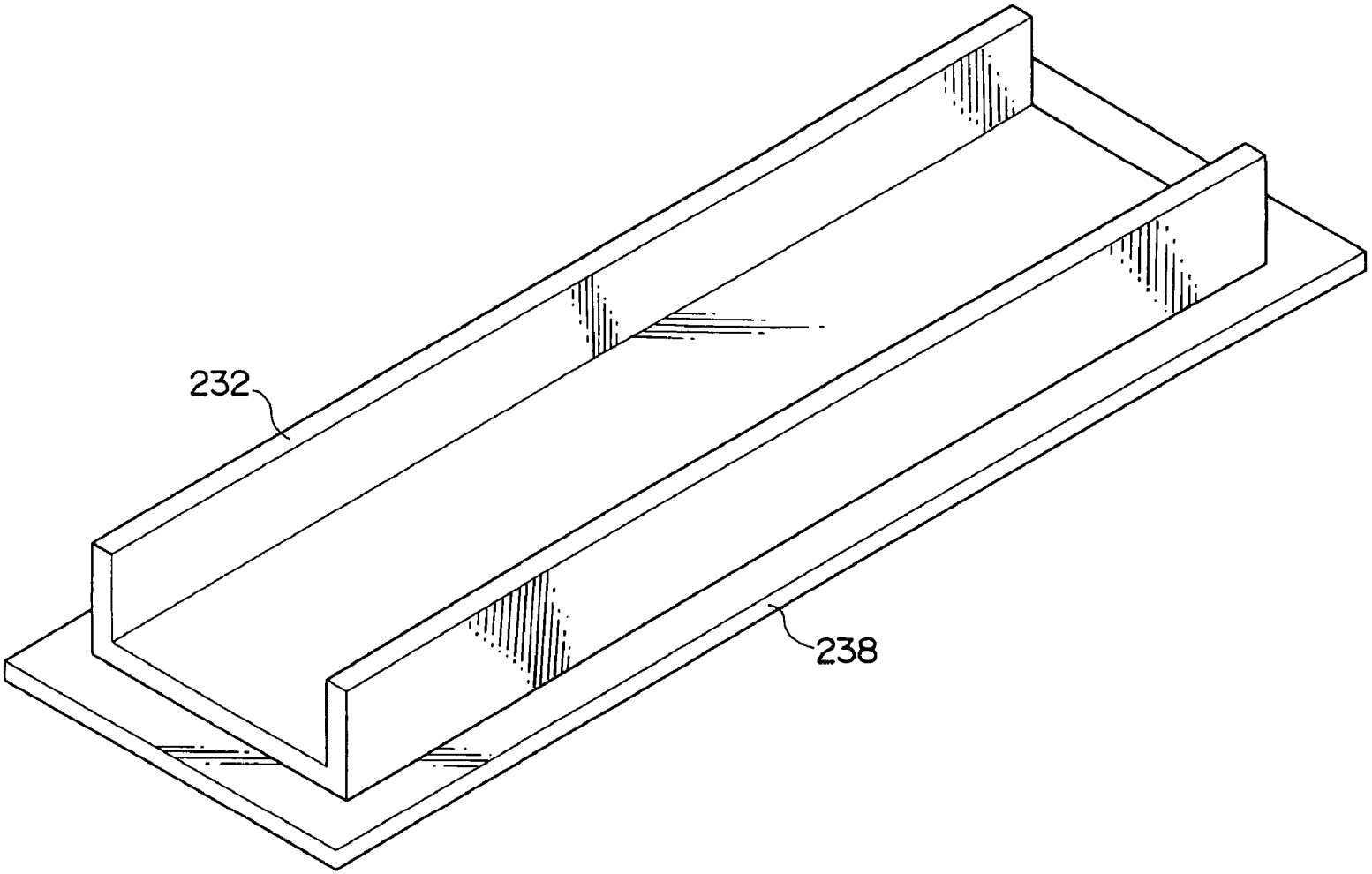
FIG. 15 is a perspective view illustrating that the cord piece table is pressed onto a rubber sheet in the fifth embodiment.
Figure 16:
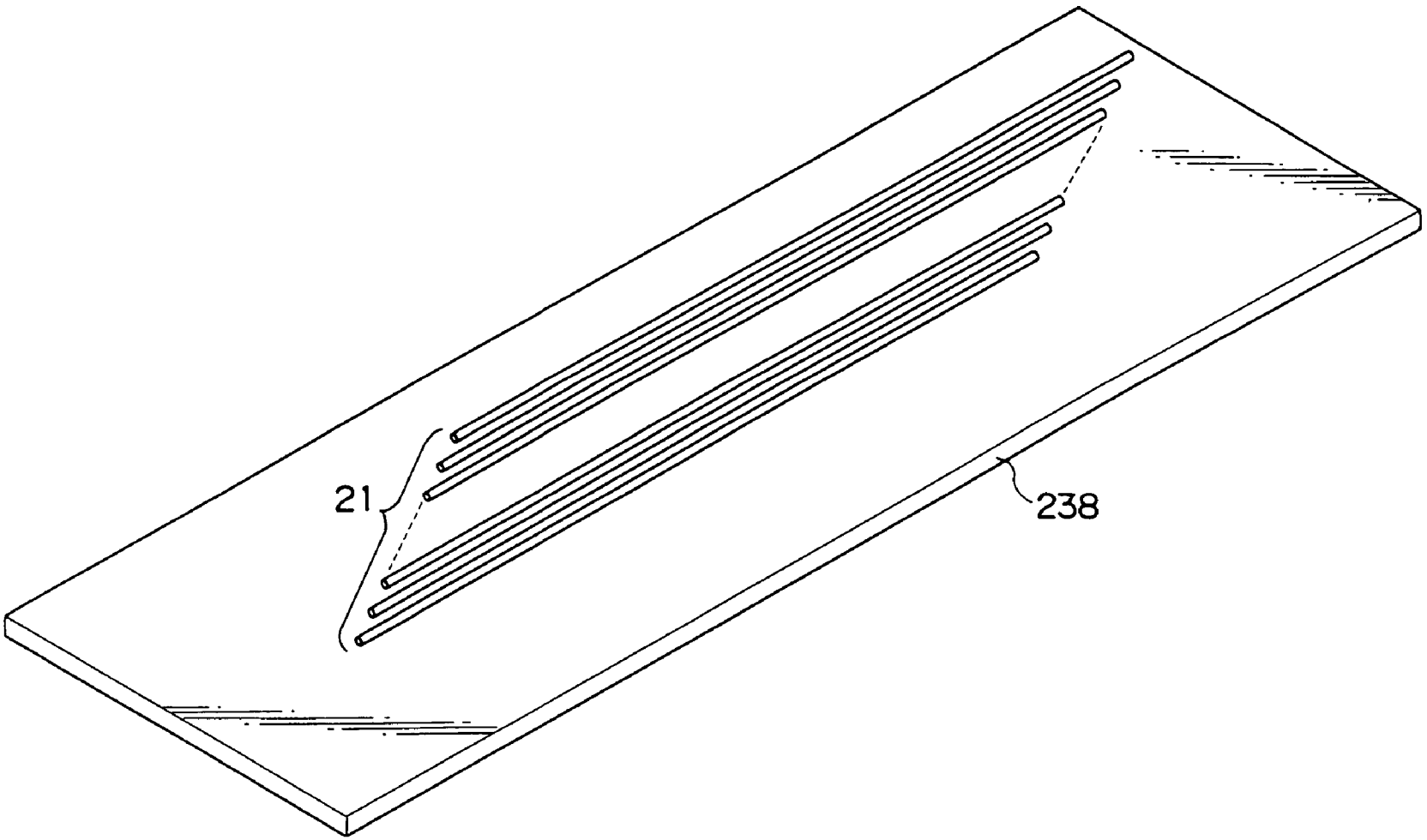
FIG. 16 is a perspective view illustrating that the cord pieces are attached to the rubber sheet when the cord piece table has been removed from the state illustrated in FIG. 15.

Subsequently, as shown in FIG. 15, the cord piece table 232 is turned over and pressed against the rubber piece 238 from above. Since an adhesion of a rubber piece 238 to the cord pieces 21 surpasses an attraction of the magnet, when the cord piece table 232 is lifted, the cord pieces 21 are transferred onto the rubber piece 238, as shown in FIG. 16.

Figure 17:
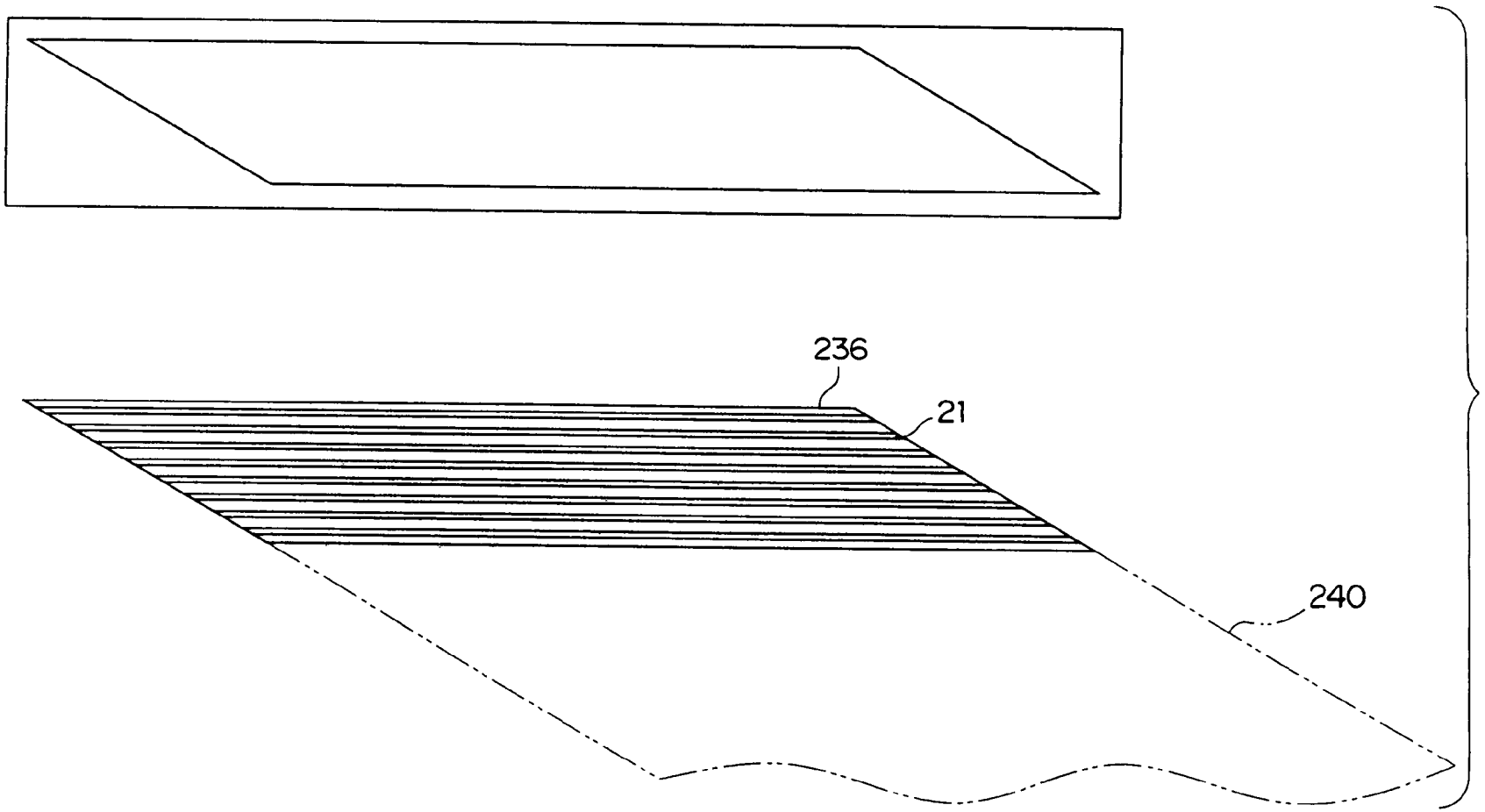
FIG. 17 is a plan view illustrating a belt piece obtained by punching in the fifth embodiment.

Then, a rubber sheet is placed over the rubber piece 238 and the cord pieces 21, and the assembly are punched with a pressing machine to form a rhomboidal belt piece 236, as shown in FIG. 17.

The belt pieces 236 thus produced are sequentially joined such that the cord pieces 21 are in parallel with each other to produce a belt ply 240.

Then, a pneumatic tire is produced using the thus made belt plies 240.

Figure 18:
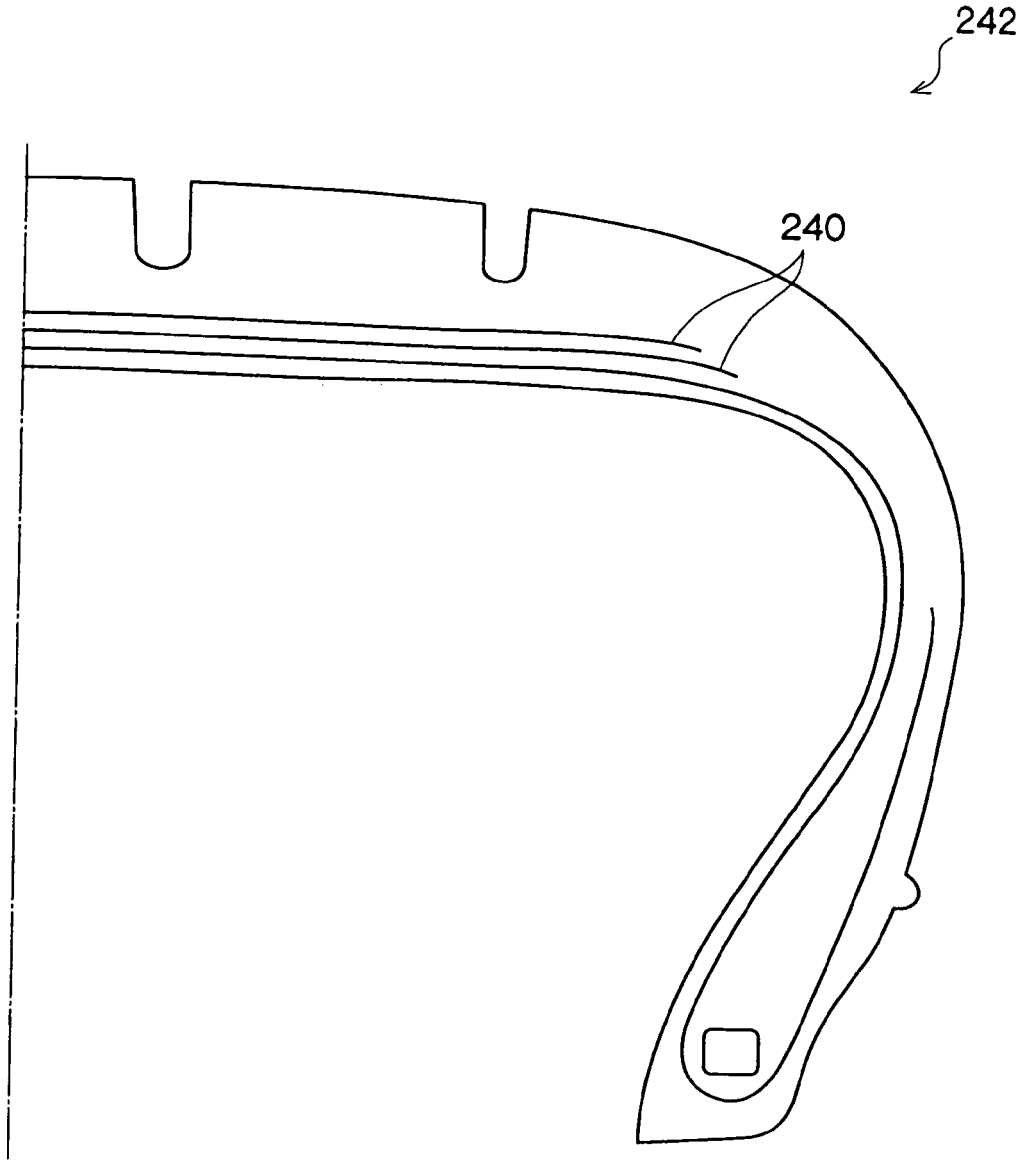
FIG. 18 is a width-directional sectional view of a pneumatic tire produced in the fifth embodiment.

As described above, in the present embodiment, the steel cord produced as described in the first embodiment is cut to a predetermined length to make the cord pieces 21, and the cord pieces 21 are used to produce the belt plies 240. Then, the belt plies 240 are used to produce a pneumatic tire. The steel cord produced as described in the first embodiment has rotating property and straightness, of which average and degree of dispersion are zero, respectively. Therefore, the belt ply 240 using the cord pieces 21 obtained by cutting the above-described steel cord has neither torsion nor warpage, and can be made completely flat. Further, a pneumatic tire 242 (see FIG. 18) using the belt ply 240 has improved tire performances such as uniformity.

It should be noted that, although the cord pieces 21 obtained by cutting the steel cord of the first embodiment is used in the present embodiment, a steel cord produced as described in the second or third embodiment may be cut and used.

Sixth Embodiment

Figure 19:
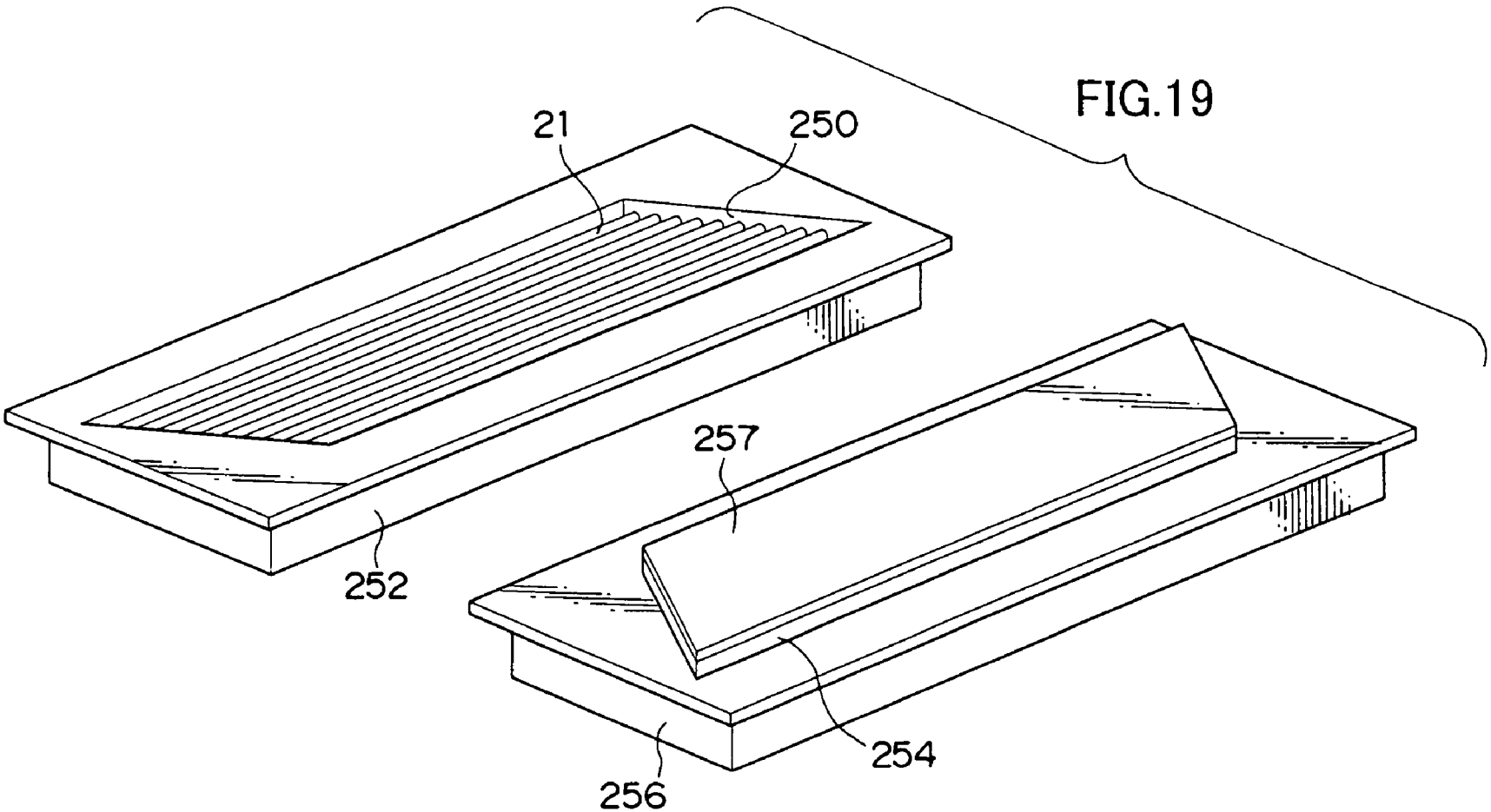
FIG. 19 is a perspective view illustrating an upper template and a lower template used in a sixth embodiment.

Next, a sixth embodiment will be described. In the present embodiment, as shown in FIG. 19, belt pieces are produced by using a lower template 252 having a rhomboidal (when viewed from above) depression 250 and an upper template 256 having a projection 254 having the same shape as the depression 250 (when viewed from above). A magnet is embedded at a bottom side of the depression 250.

First, a rubber sheet (not shown) having the same shape as the depression 250 (when viewed from above) is laid on the depression 250. Then, the steel cord pieces 21 cut to a predetermined length are placed one by one on the rubber sheet.

Further, a rubber sheet 257 having the same shape as the projection 254 (i.e., a shape obtained by inverting the rubber sheet placed in the depression 250) is laid on the projection 254.

Subsequently, the upper template 256 is inverted and the projection 254 is mated with the depression 250.

Figure 20:
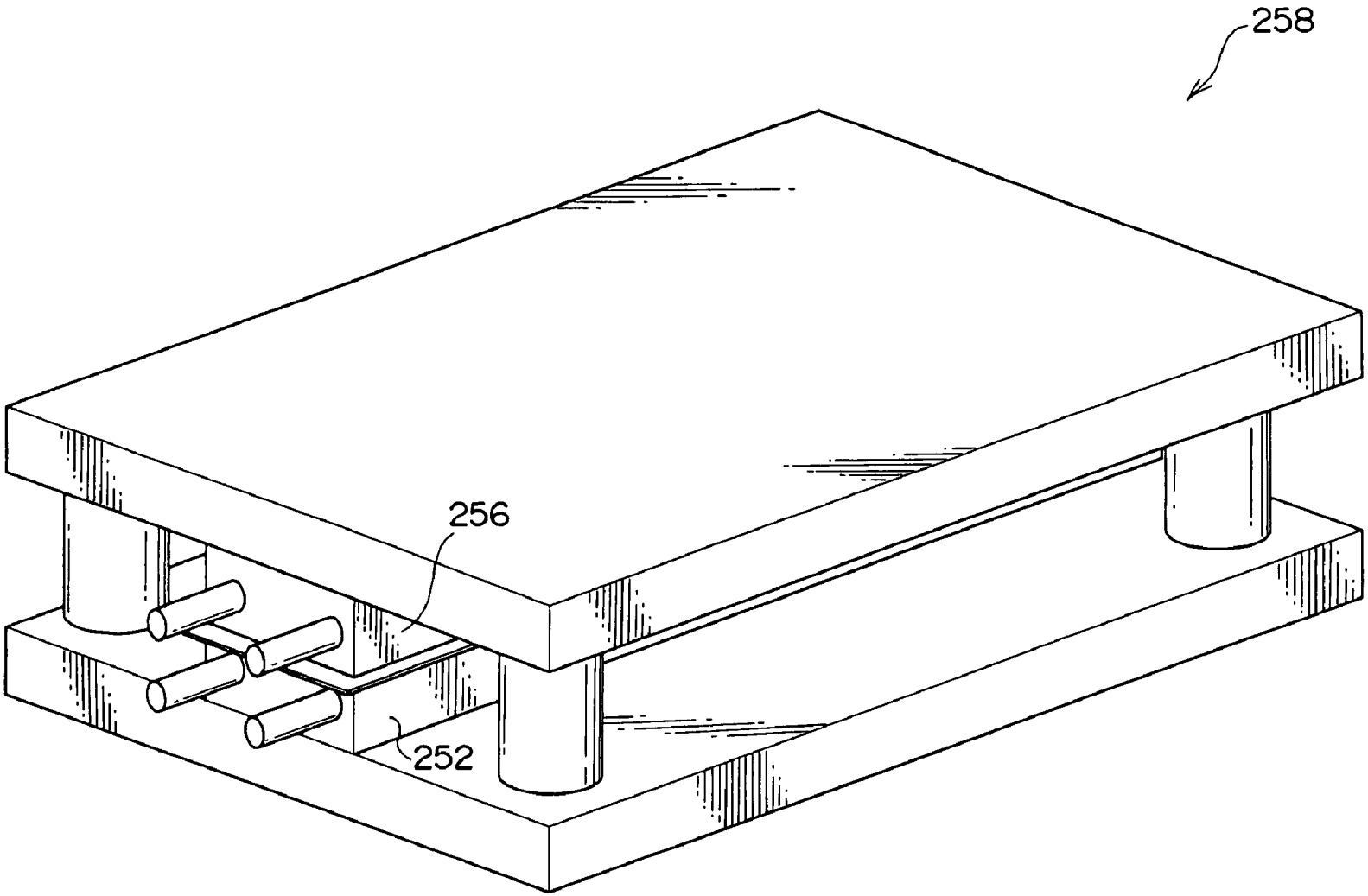
FIG. 20 is a perspective view illustrating a pressing machine used in the sixth embodiment.

Then, as shown in FIG. 20, the upper and lower templates are set in a pressing machine 258 to be pressed to form a belt piece.

In this manner, belt pieces can be obtained by using a jig having a simpler structure than that in the fifth embodiment.

Seventh Embodiment

Figure 21:
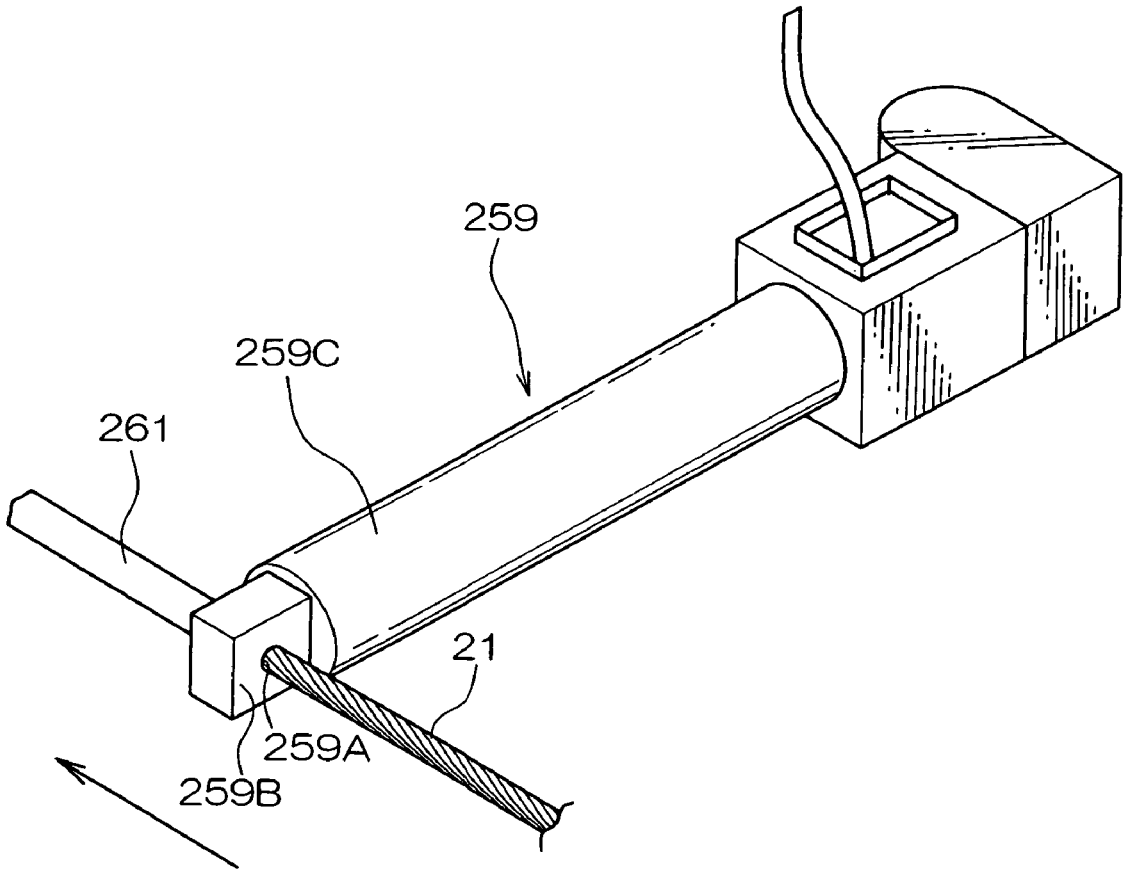
FIG. 21 is a perspective view illustrating that a rubber-coated cord is produced by passing a cord through an insulation head in a seventh embodiment.

Next, a seventh embodiment will be described. In the present embodiment, a coating device 259, as shown in FIG. 21, for coating the cord piece 21 with a rubber member is used.

The coating device 259 includes an insulation head 259B having a through hole 259A for passing the cord piece 21 therethrough, and a rubber extruder 259C for providing a rubber material for coating from a direction perpendicular to the through hole 259A.

In the present embodiment, as the cord piece 21 passes through the through hole 259A of the insulation head 259B, the cord piece 21 is coated in the through hole 259A with the rubber material extruded from the rubber extruder 259C. As a result, a rubber-coated cord 261 is discharged from the insulation head 259B.

Using the rubber-coated cord piece 261 as a tire skeleton material, an ideally flat belt ply with neither torsion nor warpage can be produced.

Eighth Embodiment

Next, an eighth embodiment will be described. In the present embodiment, a coating device 260 (see FIG. 22B) for coating the cord piece 21 (see FIG. 23) with a rubber member is used.

Figure 22A:
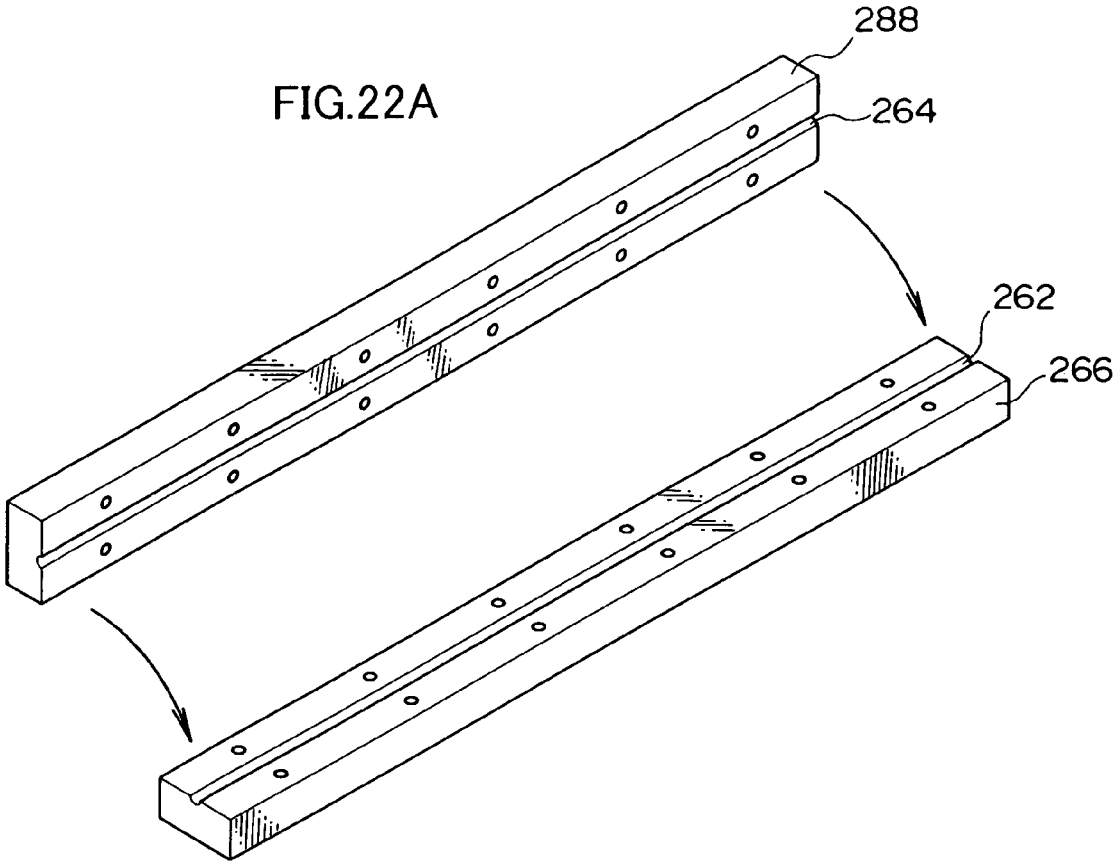
FIG. 22A is a perspective view illustrating an upper metal mold and a lower metal mold of a coating device used in an eighth embodiment.
Figure 22B:
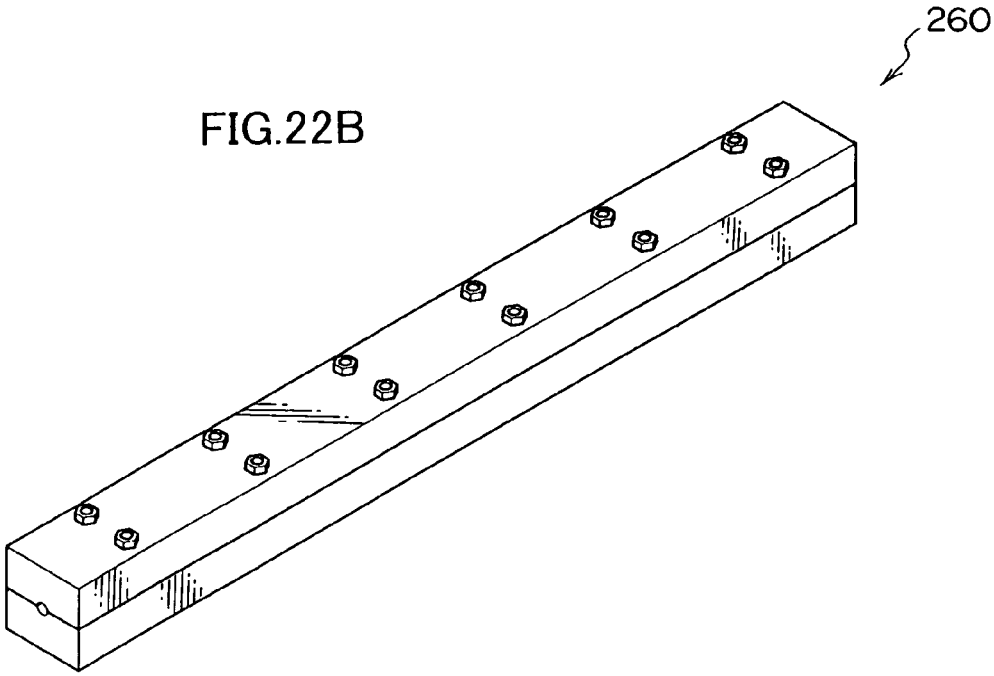
FIG. 22B is a perspective view illustrating the assembled coating device with a cord piece placed therein in the eighth embodiment.

As shown in FIG. 22A, the coating device 260 includes a lower metal mold 266 and an upper metal mold 268 that are provided with grooves 262, 264, respectively, for accommodating the cord piece.

In the present embodiment, first, the cord piece 21 is placed in the groove 262 of the lower metal mold 266, and then the upper metal mold 268 is mated with the lower metal mold 266 from above.

Subsequently, a connector member (not shown) for ramming rubber is attached, and rubber is injected.

Figure 23:
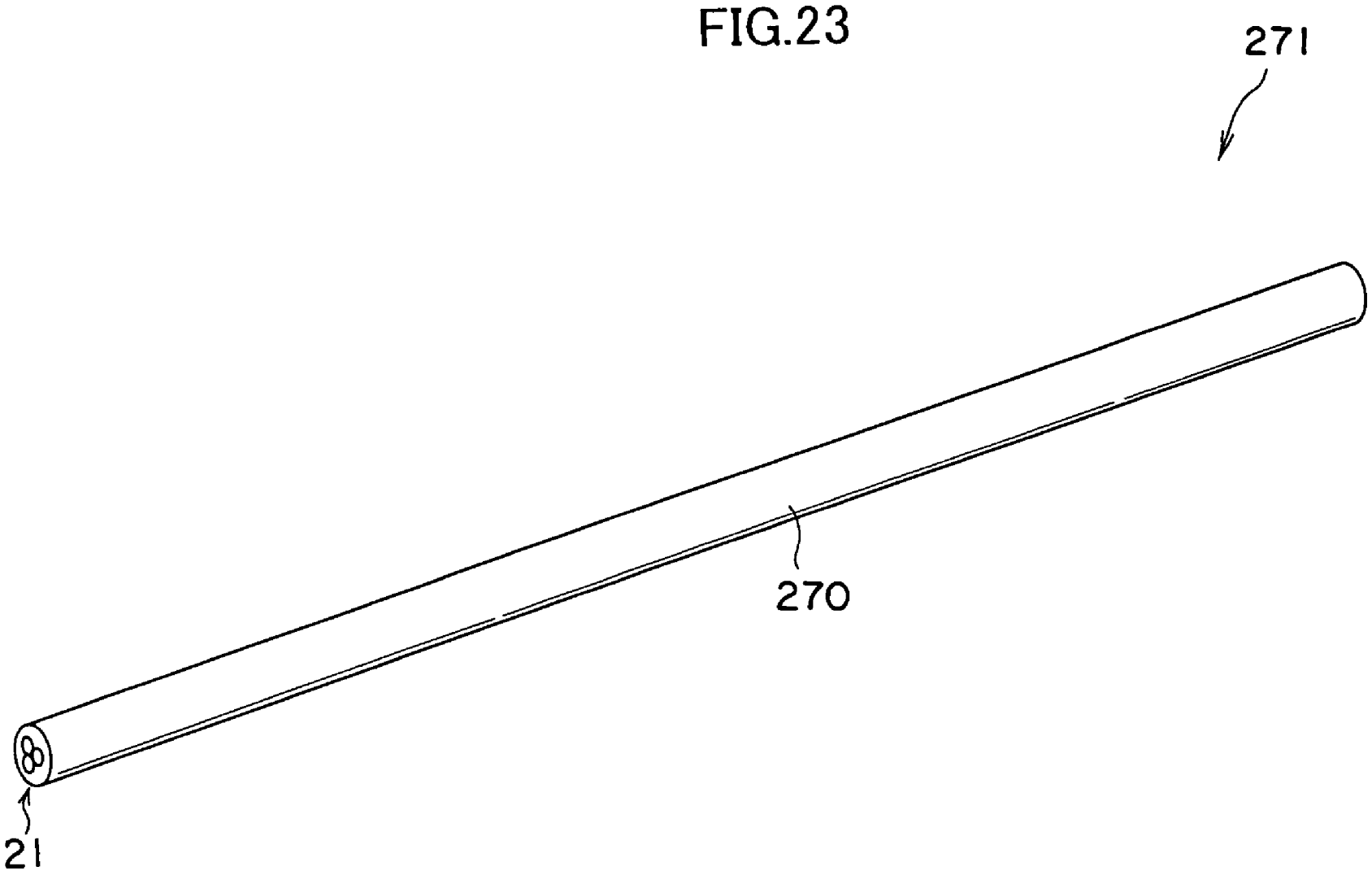
FIG. 23 is a perspective view illustrating a rubber-coated cord piece obtained in the eighth embodiment.

As a result, as shown in FIG. 23, a rubber-coating layer 270 is provided around the cord piece 21 to form a rubber-coated cord piece 271. Using the rubber-coated cord piece 271 as a tire skeleton material, an ideally flat belt ply with neither torsion nor warpage can be produced.

Opposite ends of the cord piece 21 may be completely covered with rubber so that sections of the cord piece 21 are not exposed.

Ninth Embodiment

Figure 28:
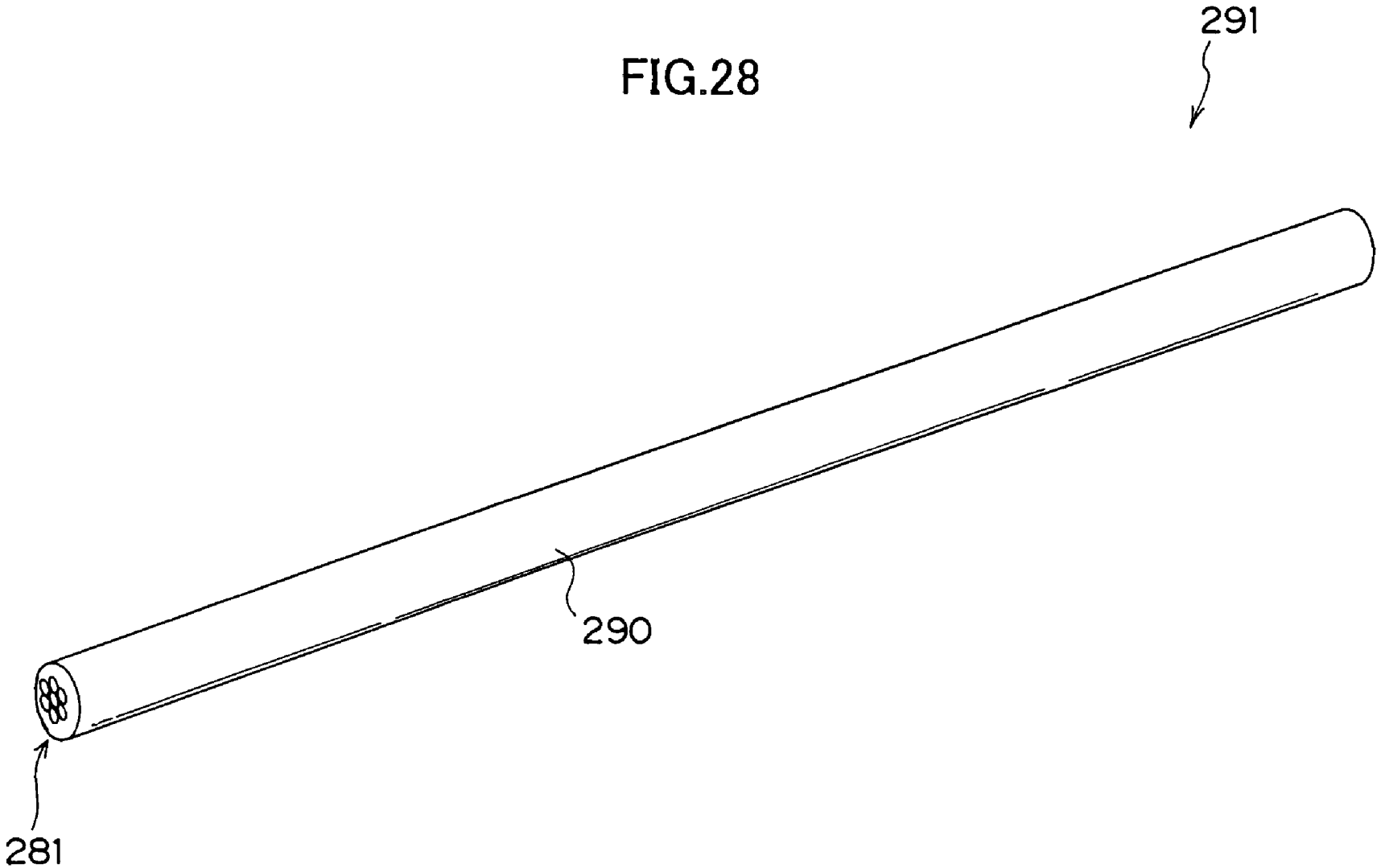
FIG. 28 is a perspective view illustrating a rubber-coated cord piece formed by the rubber ramming device of the ninth embodiment.

Next, a ninth embodiment will be described. In the present embodiment, as shown in FIG. 24, a rubber ramming device 280 for ramming rubber at a high pressure is used, so that a rubber coating layer 290 firmly contacts the cord piece 281, as shown in FIG. 28.

Figure 25:
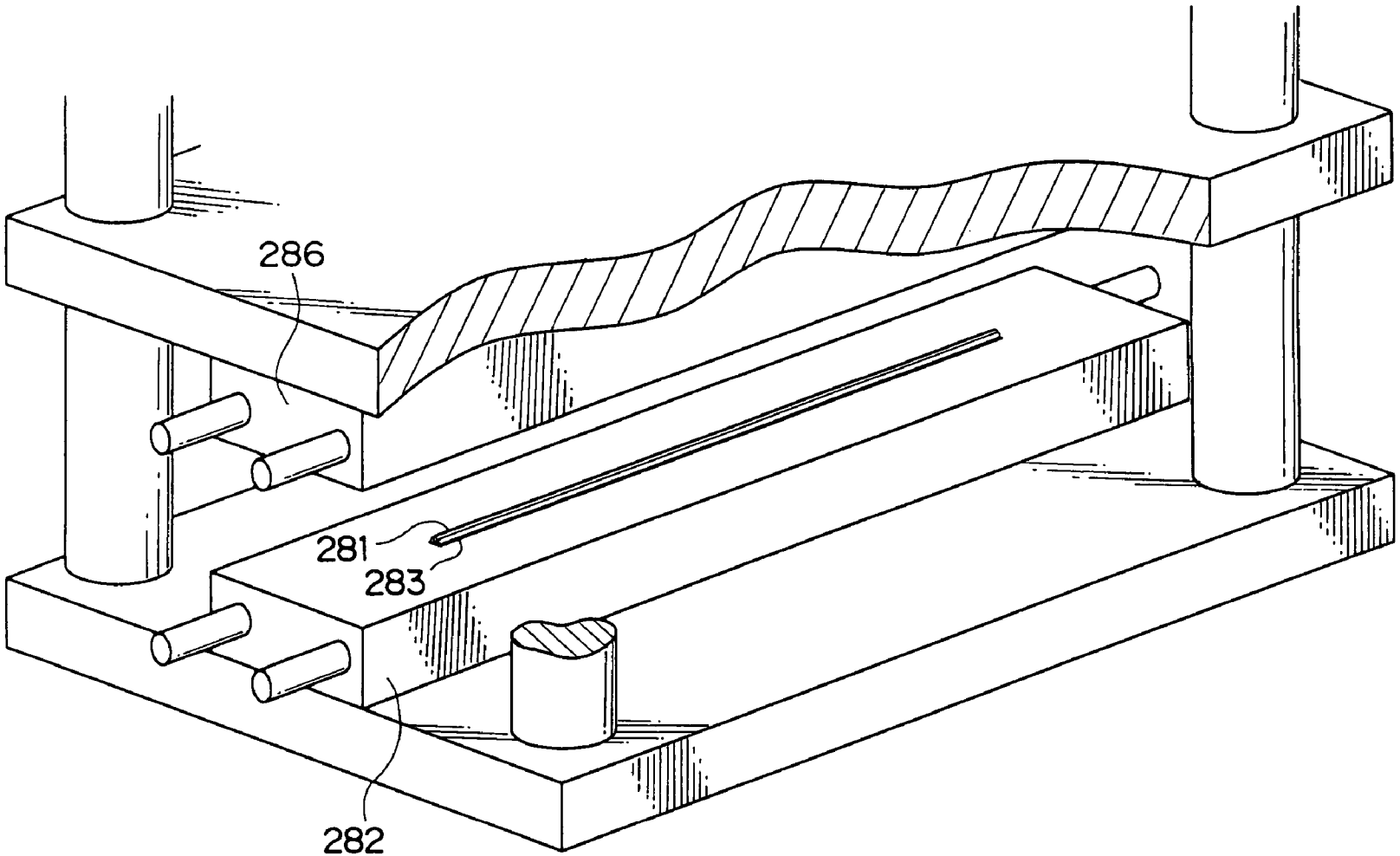
FIG. 25 is a perspective view illustrating that cords are placed on a lower metal mold of the rubber ramming device in the ninth embodiment.

The rubber ramming device 280 includes an upper metal mold 286 and a lower metal mold 282, and the lower metal mold 282 has a groove 283 formed therein for accommodating the cord piece 281, as shown in FIG. 25.

Figure 26:
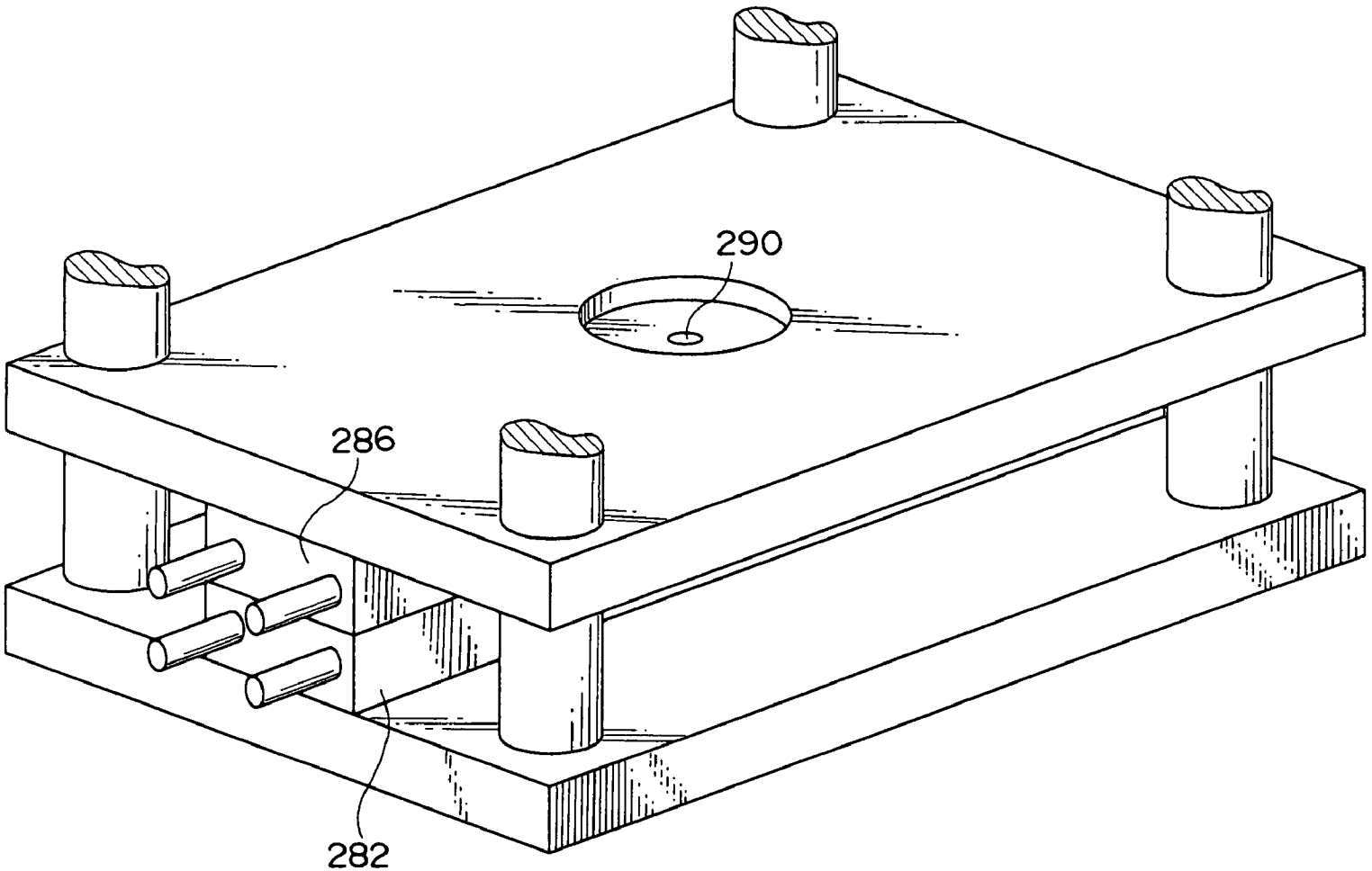
FIG. 26 is a perspective view illustrating that an upper metal mold is moved down from the state illustrated in FIG. 25 to create a closed state.

In the present embodiment, the cord piece 281 is placed in the groove 283 of the lower metal mold 282, and the upper metal mold 286 is lowered to close the metal mold, as shown in FIG. 26, and an interior of the metal mold is heated up to a predetermined temperature. The predetermined temperature is, for example, 90° C.

Figure 24:
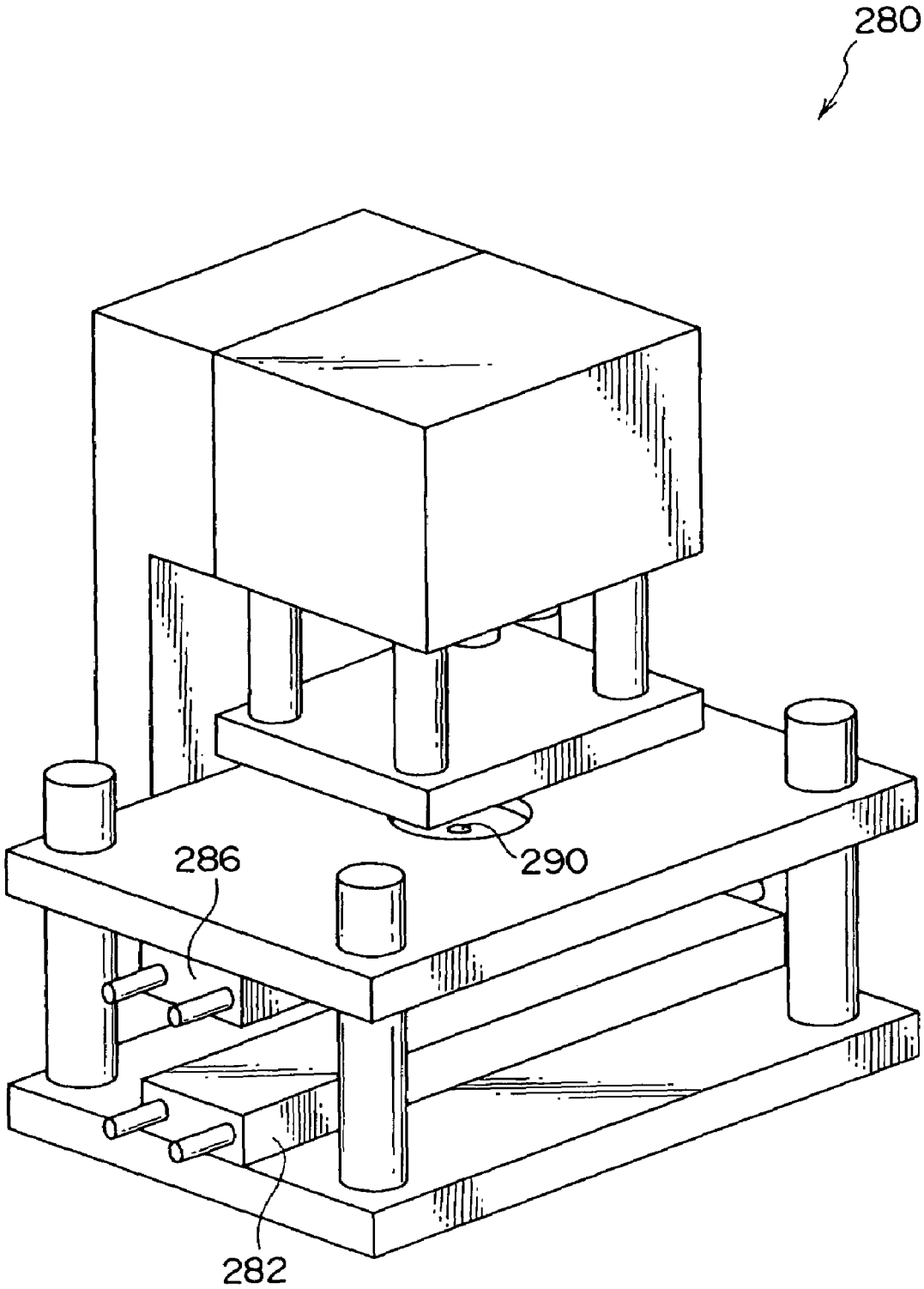
FIG. 24 is a perspective view illustrating a rubber ramming device used in a ninth embodiment.
Figure 27:
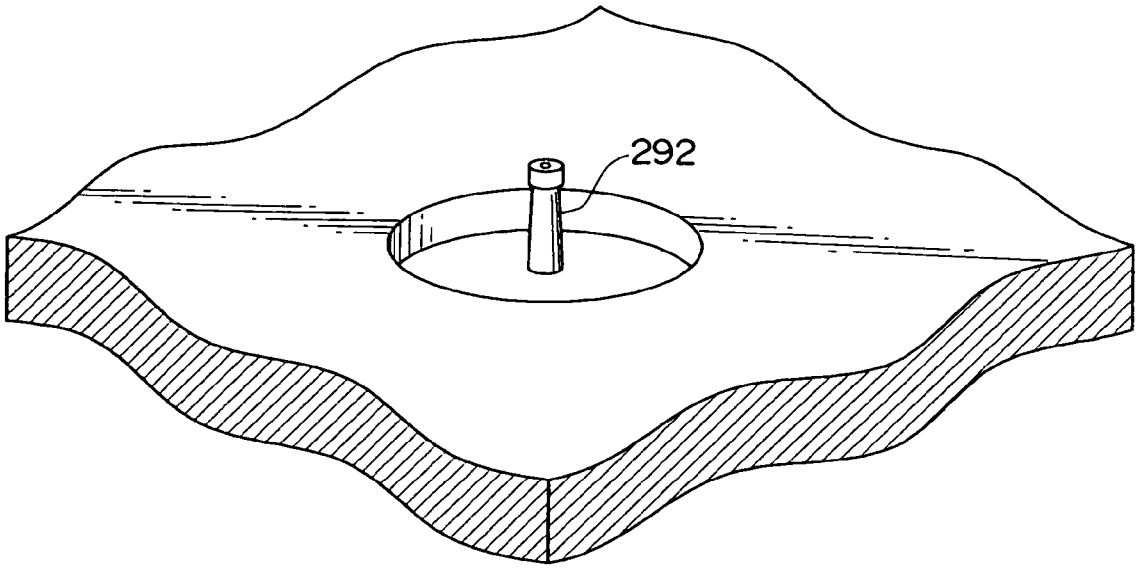
FIG. 27 is a perspective view illustrating that a cemented carbide punch is set at a rubber inlet.

Thereafter, a certain amount of rubber is charged through a rubber inlet 290 of the upper metal mold (see FIGS. 24 and 26). Further, as shown in FIG. 27, a cemented carbide punch 292 for ramming is set at the rubber inlet 290 to ram the rubber. A ramming pressure is, for example, 40 MPa.

As a result, as shown in FIG. 28, the rubber-coating layer 290 firmly contacts the cord piece 281 to provide a rubber-coated cord piece 291.

As with the eighth embodiment, both ends of the cord piece 281 may be completely covered with rubber so that sections of the cord piece 281 are not exposed.

Tenth Embodiment

Figure 29:
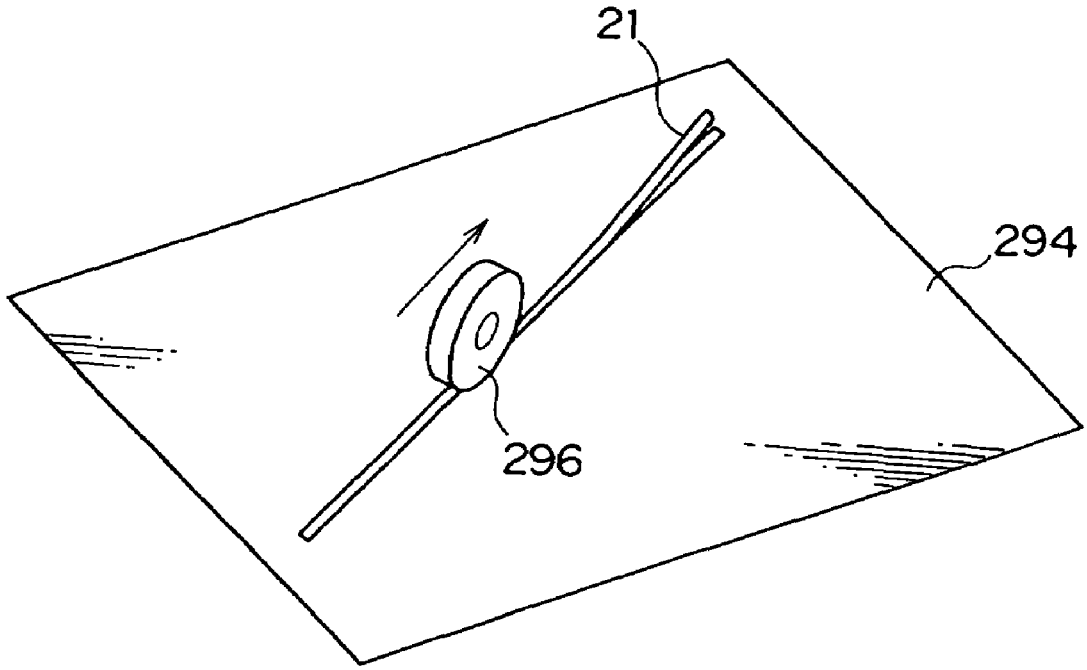
FIG. 29 is a schematic view illustrating that a cord piece is placed on a green tire and embedded by a pressing roll in the tenth embodiment.

Next, a tenth embodiment will be described. In the present embodiment, as shown in FIG. 29, each of the cord pieces 21 is positioned one by one on a sheet-like green tire 294 by robot handling and is pressed with a pressing roll 296 to be embedded in the green tire to form a belt ply.

In this manner, an ideally flat belt ply with neither torsion nor warpage can be produced, without placing the cord pieces 21 on a cord piece table or forming a rubber-coating layer on each cord piece 21.

The embodiments of the invention have been described in detail above. These embodiments are only examples, and various changes may be made without departing from the scope of the invention. Further, it is obvious that the scope of the invention is not limited to the above-described embodiments.

INDUSTRIAL APPLICABILITY

As described above, the twister according to the present invention is suitable as a compact twister, and is suitable to efficiently produce a twisted wire that is excellent in, for example, rotating property and straightness. Further, the ply according to the invention is suitable as a flat ply where torsion and warpage are suppressed. The pneumatic tire according to the invention using this ply is suitably used as a pneumatic tire in which tire performances such as uniformity have been improved.

The invention claimed is:

1. A twister comprising:

a rotating body that twists a plurality of wire materials fed thereto to form a twisted wire; and a discharging device that discharges the twisted wire from the rotating body, wherein at least one of the following conditions is met:

a) an end portion of the twisted wire downstream of a twisting point is void of a winding apparatus, and b) an end portion of each of the plurality of wire materials upstream of a twisting point are void of a winding apparatus, whereby at least one of the end portions is free to rotate with a rotation of the rotating body.

2. The twister as claimed in claim 1, wherein the discharging device is provided at the rotating body.

3. The twister as claimed in claim 1, wherein the discharging device further comprises:

a moving mechanism which holds the rotating body to be movable in a direction in which the twisted wire is discharged, and a rotating chuck provided at the rotating body which removably chucks the twisted wire.

4. The twister as claimed in claim 1, wherein the rotating body and the discharging device are configured so that a ratio of a rotational speed of the rotating body to a discharging speed of the discharging device is variable.

5. A method for producing a twisted wire by twisting a plurality of wire materials by a rotating body, wherein twisting is achieved with at least one of the following conditions is met:

a) an end portion of the twisted wire downstream of a twisting point is void of a winding apparatus, and b) an end portion of each of the plurality of wire materials upstream of a twisting point are void of a winding apparatus, whereby at least one of the end portions is free to rotate with a rotation of the rotating body.

6. The method for producing a twisted wire as claimed in claim 5, further comprising a discharging device for discharging the twisted wire from the rotating body, and wherein the rotating body and the discharging device are configured so that a ratio of a rotational speed of the rotating body to a discharging speed of the discharging device is variable to partially change a twisting pitch of the twisted wire.

7. The method for producing a twisted wire as claimed in claim 5, wherein the wire materials comprise filament or strands.

8. The twister as claimed in claim 1, wherein only the twisted wire downstream of a twisting point and the rotating body is void of a winding apparatus.

9. A twister comprising:

a rotating body that twists a plurality of wire materials fed thereto to form a twisted wire; and a discharging device that discharges the twisted wire from the rotating body, wherein the end portion of the discharged twisted wire is void of a winding apparatus, and is free to rotate with a rotation of the rotating body.

10. A twister comprising:

a rotating body that twists a plurality of wire materials fed thereto to form a twisted wire; and a discharging device that discharges the twisted wire from the rotating body, wherein the twisted wire downstream of a twisting point is provided directly to a machine for processing without being wound on a bobbin.

11. The twister as claims in claim 8, wherein the twisted wire downstream of the twisting point is void of a winding apparatus.

12. The twister as claimed in claim 1, wherein the plurality of wire materials are twisted relative to one another within the rotating body.

13. A method of forming a twisted wire using a twister comprising:

feeding a plurality of wires to a rotating body of the twister;

rotating the rotating body to twist the plurality of wires to form the twisted wire;

discharging the twisted wire from the rotating body; and satisfying at least one of the following conditions:

a) avoiding a winding structure at an end portion of the twisted wire downstream of a twisting point during an entire time that any portion of the twisted wire is within the rotating body, and b) avoiding a winding structure at an end portion of each of the plurality of wire materials upstream of a twisting point during an entire time that any portion of the plurality of wire materials is within the rotating body, whereby at least one of the end portions is free to rotate with the rotating body.

* * * * *